US010487636B2

(12) United States Patent
Motahhari et al.

(10) Patent No.: US 10,487,636 B2
(45) Date of Patent: Nov. 26, 2019

(54) ENHANCED METHODS FOR RECOVERING VISCOUS HYDROCARBONS FROM A SUBTERRANEAN FORMATION AS A FOLLOW-UP TO THERMAL RECOVERY PROCESSES

(71) Applicants: Hamed R. Motahhari, Calgary (CA); Rahman Khaledi, Calgary (CA); Nima Saber, Calgary (CA); James A. Dunn, Calgary (CA)

(72) Inventors: Hamed R. Motahhari, Calgary (CA); Rahman Khaledi, Calgary (CA); Nima Saber, Calgary (CA); James A. Dunn, Calgary (CA)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 16/036,400

(22) Filed: Jul. 16, 2018

(65) Prior Publication Data

US 2019/0032462 A1 Jan. 31, 2019

(51) Int. Cl.
*E21B 43/16* (2006.01)
*E21B 43/241* (2006.01)

(52) U.S. Cl.
CPC ..... *E21B 43/241* (2013.01); *E21B 43/16* (2013.01); *E21B 43/168* (2013.01)

(58) Field of Classification Search
CPC ..... E21B 43/16; E21B 43/168
(Continued)

(56) References Cited

U.S. PATENT DOCUMENTS 1,422,204 A 7/1922 Hoover et al.
1,491,138 A 4/1924 Hixon
(Continued)

FOREIGN PATENT DOCUMENTS

CA 0603924 A 8/1960
CA 0836325 A 3/1970
(Continued)

OTHER PUBLICATIONS

Al-Gosayier, M., et al. (2015) "In Situ Recovery of Heavy-Oil From Fractured Carbonate Reservoirs: Optimization of Steam-Over-Solvent Injection Method" *Journal of Petroleum Science and Engineering*, vol. 130, pp. 77-85.
(Continued)

*Primary Examiner* — William D Hutton, Jr.
*Assistant Examiner* — Ashish K Varma
(74) *Attorney, Agent, or Firm* — ExxonMobil Upstream Research Company-Law Department

(57) ABSTRACT

Enhanced methods for recovering viscous hydrocarbons from a subterranean formation as a follow-up to thermal recovery processes. The methods include injecting a solvent flood vapor stream into a first thermal chamber, which extends within the subterranean formation, via a solvent flood injection well that extends within the first thermal chamber. The injecting includes injecting to generate solvent flood-mobilized viscous hydrocarbons within the subterranean formation. The methods also include, at least partially concurrently with the injecting, producing the solvent flood-mobilized viscous hydrocarbons from a second thermal chamber, which extends within the subterranean formation, via a solvent flood production well that extends within the second thermal chamber. The first thermal chamber was formed via a first thermal recovery process, and the second thermal chamber was formed via a second thermal recovery
(Continued)

process, and the first thermal chamber and the second thermal chamber are in fluid communication with one another.

26 Claims, 4 Drawing Sheets

(58) Field of Classification Search
USPC ..... 166/263
See application file for complete search history.

(56) References Cited

U.S. PATENT DOCUMENTS 2,365,591 A 12/1944 Ranney
2,412,765 A 12/1946 Buddrus
2,813,583 A 11/1957 Marx et al.
2,859,818 A 11/1958 Hall et al.
2,862,558 A 12/1958 Dixon
2,910,123 A 1/1959 Elkins et al.
2,876,838 A 3/1959 Williams
2,881,838 A 4/1959 Morse et al.
2,909,224 A 10/1959 Allen
3,126,961 A 3/1964 Craig, Jr. et al.
3,156,299 A 11/1964 Trantham
3,163,215 A 12/1964 Stratton
3,174,544 A 3/1965 Campion et al.
3,182,722 A 5/1965 Reed
3,205,944 A 9/1965 Walton
3,221,809 A 12/1965 Walton
3,232,345 A 2/1966 Trantham et al.
3,237,689 A 3/1966 Justheim
3,246,693 A 4/1966 Crider
3,280,909 A 10/1966 Closmann et al.
3,294,167 A 12/1966 Vogel
3,310,109 A 3/1967 Marx et al.
3,314,476 A 4/1967 Staples et al.
3,315,745 A 4/1967 Rees, Jr.
3,322,194 A 5/1967 Strubbar
3,332,482 A 7/1967 Trantham
3,333,632 A 8/1967 Kyte
3,334,687 A 8/1967 Parker
3,342,257 A 9/1967 Jacobs et al.
3,342,259 A 9/1967 Powell
3,347,313 A 10/1967 Matthews et al.
3,349,845 A 10/1967 Holbert et al.
3,351,132 A 11/1967 Dougan et al.
3,361,201 A 1/1968 Howard
3,363,686 A 1/1968 Gilchrist
3,363,687 A 1/1968 Dean
3,373,804 A 3/1968 Glass et al.
3,379,246 A 4/1968 Skylar et al.
3,379,248 A 4/1968 Strange
3,406,755 A 10/1968 Sharp
3,411,578 A 11/1968 Holmes
3,412,793 A 11/1968 Needham
3,412,794 A 11/1968 Craighead
3,422,891 A 1/1969 Alexander et al.
3,430,700 A 3/1969 Satter et al.
3,441,083 A 4/1969 Fitzgerald
3,454,095 A 7/1969 Messenger et al.
3,454,958 A 7/1969 Parker
3,456,721 A 7/1969 Smith
3,490,529 A 1/1970 Parker
3,490,531 A 1/1970 Dixon
3,507,330 A 4/1970 Gill
3,547,192 A 12/1970 Claridge et al.
3,554,285 A 1/1971 Meldau
3,572,436 A 3/1971 Riehl
3,605,888 A 9/1971 Crowson et al.
3,608,638 A 9/1971 Terwiltiger
3,653,438 A 4/1972 Wagner
3,685,581 A 8/1972 Hess et al.
3,690,376 A 9/1972 Zwicky et al.
3,703,927 A 11/1972 Harry
3,705,625 A 12/1972 Whitten et al.
3,724,043 A 4/1973 Eustance
3,727,686 A 4/1973 Prates et al.
3,759,328 A 9/1973 Ueber et al.
3,768,559 A 10/1973 Allen et al.
3,771,598 A 11/1973 McBean
3,782,465 A 1/1974 Bell et al.
3,782,472 A 1/1974 Siess, Jr.
3,796,262 A 3/1974 Allen et al.
3,804,169 A 4/1974 Closmann
3,805,885 A 4/1974 Van Huisen
3,822,747 A 7/1974 Maguire, Jr.
3,822,748 A 7/1974 Allen et al.
3,823,777 A 7/1974 Allen et al.
3,827,495 A 8/1974 Reed
3,837,399 A 9/1974 Allen et al.
3,837,402 A 9/1974 Stringer
3,838,738 A 10/1974 Redford et al.
3,847,219 A 11/1974 Wang et al.
3,847,224 A 11/1974 Allen et al.
3,872,924 A 3/1975 Clampitt
3,881,550 A 5/1975 Barry
3,882,941 A 5/1975 Pelofsky
3,892,270 A 7/1975 Lindquist
3,905,422 A 9/1975 Woodward
3,913,671 A 10/1975 Redford et al.
3,929,190 A 12/1975 Chang et al.
3,931,856 A 1/1976 Barnes
3,941,192 A 3/1976 Carlin et al.
3,945,436 A 3/1976 Barry
3,945,679 A 3/1976 Clossmann et al.
3,946,809 A 3/1976 Hagedorn
3,946,810 A 3/1976 Barry
3,954,139 A 5/1976 Allen
3,954,141 A 5/1976 Allen et al.
3,958,636 A 5/1976 Perkins
3,964,546 A 6/1976 Allen
3,964,547 A 6/1976 Hujsak et al.
3,967,853 A 7/1976 Closmann et al.
3,978,920 A 9/1976 Bandyopadhyay et al.
3,983,939 A 10/1976 Brown et al.
3,993,133 A 11/1976 Clampitt
3,994,341 A 11/1976 Anderson et al.
3,997,004 A 12/1976 Wu
3,999,606 A 12/1976 Bandyopadhyay et al.
4,003,432 A 1/1977 Paull et al.
4,004,636 A 1/1977 Brown et al.
4,007,785 A 2/1977 Allen et al.
4,007,791 A 2/1977 Johnson
4,008,764 A 2/1977 Allen
4,008,765 A 2/1977 Anderson et al.
4,019,575 A 4/1977 Pisio et al.
4,019,578 A 4/1977 Terry et al.
4,020,901 A 5/1977 Pisio et al.
4,022,275 A 5/1977 Brandon
4,022,277 A 5/1977 Routson
4,022,279 A 5/1977 Driver
4,022,280 A 5/1977 Stoddard et al.
4,026,358 A 5/1977 Allen
4,033,411 A 7/1977 Goins
4,037,655 A 7/1977 Carpenter
4,037,658 A 7/1977 Anderson
4,049,053 A 9/1977 Fisher et al.
4,066,127 A 1/1978 Harnsberger
4,067,391 A 1/1978 Dewell
4,068,715 A 1/1978 Wu
4,068,717 A 1/1978 Needham
4,078,608 A 3/1978 Allen et al.
4,079,585 A 3/1978 Helleur
4,084,637 A 4/1978 Todd
4,085,799 A 4/1978 Bousaid et al.
4,085,800 A 4/1978 Engle et al.
4,085,803 A 4/1978 Butler
4,088,188 A 5/1978 Widmyer
4,099,564 A 7/1978 Hutchinson
4,099,568 A 7/1978 Allen
4,109,720 A 8/1978 Allen et al.
4,114,687 A 9/1978 Payton
4,114,691 A 9/1978 Payton
4,116,275 A 9/1978 Butler et al.

(56) References Cited

U.S. PATENT DOCUMENTS 4,119,149 A 10/1978 Wu et al.
4,120,357 A 10/1978 Anderson
4,124,071 A 11/1978 Allen et al.
4,124,074 A 11/1978 Allen et al.
4,127,170 A 11/1978 Redford
4,129,183 A 12/1978 Kalfoglou
4,129,308 A 12/1978 Hutchinson
4,130,163 A 12/1978 Bombardieri
4,133,382 A 1/1979 Cram et al.
4,133,384 A 1/1979 Allen et al.
4,140,180 A 2/1979 Bridges et al.
4,140,182 A 2/1979 Vriend
4,141,415 A 2/1979 Wu et al.
4,144,935 A 3/1979 Bridges et al.
RE30,019 E 6/1979 Lindquist
4,160,479 A 7/1979 Richardson et al.
4,160,481 A 7/1979 Turk et al.
4,166,503 A 9/1979 Hall et al.
4,174,752 A 11/1979 Slater et al.
4,175,618 A 11/1979 Wu et al.
4,191,252 A 3/1980 Buckley et al.
4,202,168 A 5/1980 Acheson et al.
4,202,169 A 5/1980 Acheson et al.
4,207,945 A 6/1980 Hall et al.
4,212,353 A 7/1980 Hall
4,217,956 A 8/1980 Goss et al.
4,223,728 A 9/1980 Pegg
4,228,853 A 10/1980 Harvey et al.
4,228,854 A 10/1980 Sacuta
4,228,856 A 10/1980 Reale
4,246,966 A 1/1981 Stoddard et al.
4,248,302 A 2/1981 Churchman
4,249,602 A 2/1981 Burton, III et al.
4,250,964 A 2/1981 Jewell et al.
4,252,194 A 2/1981 Felber et al.
4,260,018 A 4/1981 Shum et al.
4,262,745 A 4/1981 Stewart
4,265,310 A 5/1981 Britton et al.
4,270,609 A 6/1981 Choules
4,271,905 A 6/1981 Redford et al.
4,274,487 A 6/1981 Hollingsworth et al.
4,280,559 A 7/1981 Best
4,282,929 A 8/1981 Krajicek
4,284,139 A 8/1981 Sweany
RE30,738 E 9/1981 Bridges et al.
4,289,203 A 9/1981 Swanson
4,295,980 A 10/1981 Motz
4,296,814 A 10/1981 Stalder et al.
4,300,634 A 11/1981 Clampitt
4,303,126 A 12/1981 Blevins
4,305,463 A 12/1981 Zakiewicz
4,306,981 A 12/1981 Blair, Jr.
4,319,632 A 3/1982 Marr, Jr.
4,319,635 A 3/1982 Jones
4,324,291 A 4/1982 Wong et al.
4,325,432 A 4/1982 Henry
4,326,968 A 4/1982 Blair, Jr.
4,327,805 A 5/1982 Poston
4,330,038 A 5/1982 Soukup et al.
4,333,529 A 6/1982 McCorquodale
4,344,483 A 8/1982 Fisher et al.
4,344,485 A 8/1982 Butler
4,344,486 A 8/1982 Parrish
4,345,652 A 8/1982 Roque
4,362,213 A 12/1982 Tabor
4,372,385 A 2/1983 Rhoades et al.
4,372,386 A 2/1983 Rhoades et al.
4,379,489 A 4/1983 Rollmann
4,379,592 A 4/1983 Vakhnin et al.
4,380,265 A 4/1983 Mohaupt
4,380,267 A 4/1983 Fox
4,381,124 A 4/1983 Verty et al.
4,382,469 A 5/1983 Bell et al.
4,385,661 A 5/1983 Fox
4,387,016 A 6/1983 Gagon
4,389,320 A 6/1983 Clampitt
4,390,062 A 6/1983 Fox
4,390,067 A 6/1983 William
4,392,530 A 7/1983 Odeh et al.
4,393,937 A 7/1983 Dilgren et al.
4,396,063 A 8/1983 Godbey
4,398,602 A 8/1983 Anderson
4,398,692 A 8/1983 Macfie
4,406,499 A 9/1983 Yildirim
4,407,367 A 10/1983 Kydd
4,410,216 A 10/1983 Allen
4,411,618 A 10/1983 Donaldson et al.
4,412,585 A 11/1983 Bouck
4,415,034 A 11/1983 Bouck
4,417,620 A 11/1983 Shafir
4,418,752 A 12/1983 Boyer et al.
4,423,779 A 1/1984 Livingston
4,427,528 A 1/1984 Lindörfer et al.
4,429,744 A 2/1984 Cook
4,429,745 A 2/1984 Cook
4,431,056 A 2/1984 Shu
4,434,851 A 3/1984 Haynes, Jr. et al.
4,441,555 A 4/1984 Shu
4,444,257 A 4/1984 Stine
4,444,261 A 4/1984 Islip
4,445,573 A 5/1984 McCaleb
4,448,251 A 5/1984 Stine
4,450,909 A 5/1984 Sacuta
4,450,911 A 5/1984 Seglin et al.
4,450,913 A 5/1984 Allen et al.
4,452,491 A 6/1984 Seglin et al.
4,453,597 A 6/1984 Brown et al.
4,456,065 A 6/1984 Heim et al.
4,456,066 A 6/1984 Shu
4,456,068 A 6/1984 Burrill, Jr. et al.
4,458,756 A 7/1984 Clark
4,458,759 A 7/1984 Isaacs et al.
4,460,044 A 7/1984 Porter
4,465,137 A 8/1984 Sustek, Jr. et al.
4,466,485 A 8/1984 Shu
4,469,177 A 9/1984 Venkatesan
4,471,839 A 9/1984 Snavely et al.
4,473,114 A 9/1984 Bell et al.
4,475,592 A 10/1984 Pachovsky
4,475,595 A 10/1984 Watkins et al.
4,478,280 A 10/1984 Hopkins et al.
4,478,705 A 10/1984 Ganguli
4,480,689 A 11/1984 Wunderlich
4,484,630 A 11/1984 Chung
4,485,868 A 12/1984 Sresty et al.
4,487,262 A 12/1984 Venkatesan et al.
4,487,264 A 12/1984 Hyne et al.
4,488,600 A 12/1984 Fan
4,488,976 A 12/1984 Dilgren et al.
4,491,180 A 1/1985 Brown et al.
4,495,994 A 1/1985 Brown et al.
4,498,537 A 2/1985 Cook
4,498,542 A 2/1985 Eisenhawer et al.
4,499,946 A 2/1985 Martin et al.
4,501,325 A 2/1985 Frazier et al.
4,501,326 A 2/1985 Edmunds
4,501,445 A 2/1985 Gregoli
4,503,910 A 3/1985 Shu
4,503,911 A 3/1985 Harman et al.
4,508,170 A 4/1985 Littman
4,513,819 A 4/1985 Islip et al.
4,515,215 A 5/1985 Hermes et al.
4,516,636 A 5/1985 Doscher
4,522,260 A 6/1985 Wolcott, Jr.
4,522,263 A 6/1985 Hopkins et al.
4,524,826 A 6/1985 Savage
4,527,650 A 7/1985 Bartholet
4,528,104 A 7/1985 House et al.
4,530,401 A 7/1985 Hartman et al.
4,532,993 A 8/1985 Dilgren et al.
4,532,994 A 8/1985 Toma et al.
4,535,845 A 8/1985 Brown et al.
4,540,049 A 9/1985 Hawkins et al.
4,540,050 A 9/1985 Huang et al.

(56) References Cited

U.S. PATENT DOCUMENTS 4,545,435 A 10/1985 Bridges et al.
4,546,829 A 10/1985 Martin et al.
4,550,779 A 11/1985 Zakiewicz
4,556,107 A 12/1985 Duerksen et al.
4,558,740 A 12/1985 Yellig, Jr.
4,565,245 A 1/1986 Mims et al.
4,565,249 A 1/1986 Pebdani et al.
4,572,296 A 2/1986 Watkins
4,574,884 A 3/1986 Schmidt
4,574,886 A 3/1986 Hopkins et al.
4,577,688 A 3/1986 Gassmann et al.
4,579,176 A 4/1986 Davies et al.
4,589,487 A 5/1986 Venkatesan et al.
4,595,057 A 6/1986 Deming et al.
4,597,441 A 7/1986 Ware et al.
4,597,443 A 7/1986 Shu et al.
4,598,770 A 7/1986 Shu et al.
4,601,337 A 7/1986 Lau et al.
4,601,338 A 7/1986 Prats et al.
4,607,695 A 8/1986 Weber
4,607,699 A 8/1986 Stephens
4,607,700 A 8/1986 Duerksen et al.
4,610,304 A 9/1986 Doscher
4,612,989 A 9/1986 Rakach et al.
4,612,990 A 9/1986 Shu
4,615,391 A 10/1986 Garthoffner
4,620,592 A 11/1986 Perkins
4,620,593 A 11/1986 Haagensen
4,635,720 A 1/1987 Chew
4,637,461 A 1/1987 Hight
4,637,466 A 1/1987 Hawkins et al.
4,640,352 A 2/1987 Vanmeurs et al.
4,640,359 A 2/1987 Livesey et al.
4,641,710 A 2/1987 Klinger
4,645,003 A 2/1987 Huang et al.
4,645,004 A 2/1987 Bridges et al.
4,646,824 A 3/1987 Huang et al.
4,648,835 A 3/1987 Esienhawer et al.
4,651,825 A 3/1987 Wilson
4,651,826 A 3/1987 Holmes
4,653,583 A 3/1987 Huang et al.
4,662,438 A 5/1987 Taflove et al.
4,662,440 A 5/1987 Harmon et al.
4,662,441 A 5/1987 Huang et al.
4,665,035 A 5/1987 Tunac
4,665,989 A 5/1987 Wilson
4,667,739 A 5/1987 Van Meurs et al.
4,679,626 A 7/1987 Perkins
4,682,652 A 7/1987 Huang et al.
4,682,653 A 7/1987 Angstadt
4,685,515 A 8/1987 Huang et al.
4,687,058 A 8/1987 Casad et al.
4,690,215 A 9/1987 Roberts et al.
4,691,773 A 9/1987 Ward et al.
4,694,907 A 9/1987 Stahl et al.
4,696,311 A 9/1987 Muiis et al.
4,697,642 A 10/1987 Vogel
4,699,213 A 10/1987 Fleming
4,700,779 A 10/1987 Huang et al.
4,702,314 A 10/1987 Huang et al.
4,702,317 A 10/1987 Shen
4,705,108 A 11/1987 Little et al.
4,706,751 A 11/1987 Gondouin
4,707,230 A 11/1987 Ajami
4,718,485 A 1/1988 Brown et al.
4,718,489 A 1/1988 Hallam et al.
4,727,489 A 2/1988 Frazier et al.
4,727,937 A 3/1988 Shum et al.
4,739,831 A 4/1988 Settlemeyer et al.
4,753,293 A 6/1988 Bohn
4,756,369 A 7/1988 Jennings, Jr. et al.
4,757,833 A 7/1988 Danley
4,759,571 A 7/1988 Stone et al.
4,766,958 A 8/1988 Faecke
4,769,161 A 9/1988 Angstadt
4,775,450 A 10/1988 Ajami
4,782,901 A 11/1988 Phelps et al.
4,785,028 A 11/1988 Hoskin et al.
4,785,883 A 11/1988 Hoskin et al.
4,787,452 A 11/1988 Jennings, Jr.
4,793,409 A 12/1988 Bridges et al.
4,793,415 A 12/1988 Holmes et al.
4,804,043 A 2/1989 Shu et al.
4,809,780 A 3/1989 Shen
4,813,483 A 3/1989 Ziegler
4,817,711 A 4/1989 Jeambey
4,817,714 A 4/1989 Jones
4,818,370 A 4/1989 Gregoli et al.
4,819,724 A 4/1989 Bou-Mikael
4,828,030 A 5/1989 Jennings, Jr.
4,828,031 A 5/1989 Davis
4,828,032 A 5/1989 Telezke et al.
4,834,174 A 5/1989 Vandevier
4,834,179 A 5/1989 Kokolis et al.
4,844,155 A 7/1989 Megyeri et al.
4,846,275 A 7/1989 McKay
4,850,429 A 7/1989 Mims et al.
4,856,587 A 8/1989 Nielson
4,856,856 A 8/1989 Phelps et al.
4,860,827 A 8/1989 Lee et al.
4,861,263 A 8/1989 Schirmer
4,867,238 A 9/1989 Bayless et al.
4,869,830 A 9/1989 Konak et al.
4,874,043 A 10/1989 Joseph et al.
4,877,542 A 10/1989 Lon et al.
4,884,155 A 11/1989 Spash
4,884,635 A 12/1989 McKay et al.
4,886,118 A 12/1989 Van Meurs et al.
4,892,146 A 1/1990 Shen
4,895,085 A 1/1990 Chips
4,895,206 A 1/1990 Price
4,896,725 A 1/1990 Parker et al.
4,901,795 A 2/1990 Phelps et al.
4,903,766 A 2/1990 Shu
4,903,768 A 2/1990 Shu
4,903,770 A 2/1990 Friedeman et al.
4,915,170 A 4/1990 Hoskin
4,919,206 A 4/1990 Freeman et al.
4,926,941 A 5/1990 Glandt et al.
4,926,943 A 5/1990 Hoskin
4,928,766 A 5/1990 Hoskin
4,930,454 A 6/1990 Latty et al.
4,940,091 A 7/1990 Shu et al.
4,945,984 A 8/1990 Price
4,947,933 A 8/1990 Jones et al.
4,961,467 A 10/1990 Pebdani
4,962,814 A 10/1990 Alameddine
4,964,461 A 10/1990 Shu
4,966,235 A 10/1990 Gregoli et al.
4,969,520 A 11/1990 Jan et al.
4,974,677 A 12/1990 Shu
4,982,786 A 1/1991 Jennings, Jr.
4,983,364 A 1/1991 Buck et al.
4,991,652 A 2/1991 Hoskin et al.
5,010,953 A 4/1991 Friedman et al.
5,013,462 A 5/1991 Danley
5,014,787 A 5/1991 Duerksen
5,016,709 A 5/1991 Combe et al.
5,016,710 A 5/1991 Renard et al.
5,016,713 A 5/1991 Sanchez et al.
5,024,275 A 6/1991 Anderson et al.
5,025,863 A 6/1991 Haines
5,027,898 A 7/1991 Naae
5,036,915 A 8/1991 Wyganowski
5,036,917 A 8/1991 Jennings, Jr. et al.
5,036,918 A 8/1991 Jennings, Jr. et al.
5,040,605 A 8/1991 Showalter
5,042,579 A 8/1991 Glandt et al.
5,046,559 A 9/1991 Glandt
5,046,560 A 9/1991 Teletzke et al.
5,052,482 A 10/1991 Gondouin
5,054,551 A 10/1991 Duerksen
5,056,596 A 10/1991 McKay et al.
5,058,681 A 10/1991 Reed

(56) References Cited

U.S. PATENT DOCUMENTS 5,060,726 A 10/1991 Glandt et al.
5,065,819 A 11/1991 Kasevich
5,083,612 A 1/1992 Ashrawi
5,083,613 A 1/1992 Gregoli et al.
5,085,275 A 2/1992 Gondouin
5,095,984 A 3/1992 Irani
5,099,918 A 3/1992 Bridges et al.
5,101,898 A 4/1992 Hong
5,105,880 A 4/1992 Shen
5,109,927 A 5/1992 Supernaw et al.
5,123,485 A 6/1992 Vasicek et al.
5,131,471 A 7/1992 Duerksen et al.
5,145,002 A 9/1992 McKay
5,145,003 A 9/1992 Duerksen
5,148,869 A 9/1992 Sanchez
5,152,341 A 10/1992 Kasevich et al.
5,156,214 A 10/1992 Hoskin et al.
5,167,280 A 12/1992 Sanchez et al.
5,172,763 A 12/1992 Mohammadi et al.
5,174,377 A 12/1992 Kumar
5,178,217 A 1/1993 Mohammadi et al.
5,186,256 A 2/1993 Downs
5,197,541 A 3/1993 Hess et al.
5,199,488 A 4/1993 Kasevich et al.
5,199,490 A 4/1993 Surles et al.
5,201,815 A 4/1993 Hong et al.
5,215,146 A 6/1993 Sanchez
5,215,149 A 6/1993 Lu
5,236,039 A 8/1993 Edelstein et al.
5,238,066 A 8/1993 Beattie et al.
5,246,071 A 9/1993 Chu
5,247,993 A 9/1993 Sarem et al.
5,252,226 A 10/1993 Justice
5,271,693 A 12/1993 Johnson et al.
5,273,111 A 12/1993 Brannan et al.
5,277,830 A 1/1994 Hoskin et al.
5,279,367 A 1/1994 Osterloh
5,282,508 A 2/1994 Ellingsen et al.
5,289,881 A 3/1994 Schuh
5,293,936 A 3/1994 Bridges
5,295,540 A 3/1994 Djabbarah et al.
5,297,627 A 3/1994 Sanchez et al.
5,305,829 A 4/1994 Kumar
5,318,124 A 6/1994 Ong et al.
5,325,918 A 7/1994 Berryman et al.
5,339,897 A 8/1994 Leaute
5,339,898 A 8/1994 Yu et al.
5,339,904 A 8/1994 Jennings, Jr. et al.
5,350,014 A 9/1994 McKay
5,358,054 A 10/1994 Bert
5,361,845 A 11/1994 Jamaluddin et al.
5,377,757 A 1/1995 Ng
5,404,950 A 4/1995 Ng et al.
5,407,009 A 4/1995 Butler et al.
5,411,086 A 5/1995 Burcham et al.
5,411,089 A 5/1995 Vinegar et al.
5,411,094 A 5/1995 Northrop
5,413,175 A 5/1995 Edmunds
5,414,231 A 5/1995 Sato et al.
5,417,283 A 5/1995 Ejiogu et al.
5,431,224 A 7/1995 Laali
5,433,271 A 7/1995 Vinegar et al.
5,449,038 A 9/1995 Horton et al.
5,450,902 A 9/1995 Mathews
5,456,315 A 10/1995 Kinsman et al.
5,458,193 A 10/1995 Horton et al.
5,483,801 A 1/1996 Craze
5,503,226 A 4/1996 Wadleigh
5,511,616 A 4/1996 Bert
5,513,705 A 5/1996 Djabbarah et al.
5,531,272 A 7/1996 Ng et al.
5,534,186 A 7/1996 Walker et al.
5,542,474 A 8/1996 Djabbarah et al.
5,547,022 A 8/1996 Juprasert et al.
5,553,974 A 9/1996 Nazarian
5,560,737 A 10/1996 Schuring et al.
5,565,139 A 10/1996 Walker et al.
5,589,775 A 12/1996 Kuckes
5,607,016 A 3/1997 Butler
5,607,018 A 3/1997 Schuh
5,626,191 A 5/1997 Greaves et al.
5,626,193 A 5/1997 Nzekwu et al.
5,635,139 A 6/1997 Holst et al.
5,646,309 A 7/1997 Hammarberg et al.
5,650,128 A 7/1997 Holst et al.
5,660,500 A 8/1997 Marsden, Jr. et al.
5,674,816 A 10/1997 Loree
5,677,267 A 10/1997 Suarez et al.
5,682,613 A 11/1997 Dinatale
5,685,371 A 11/1997 Richardson et al.
5,691,906 A 11/1997 Togashi et al.
5,709,505 A 1/1998 Williams et al.
5,713,415 A 2/1998 Bridges
5,720,350 A 2/1998 McGuire
5,725,054 A 3/1998 Shayegi
5,738,937 A 4/1998 Baychar
5,765,964 A 6/1998 Calcote et al.
5,771,973 A 6/1998 Jensen
5,788,412 A 8/1998 Jatkar
RE35,891 E 9/1998 Jamaluddin et al.
5,803,171 A 9/1998 McCaffery et al.
5,803,178 A 9/1998 Cain
5,813,799 A 9/1998 Calcote et al.
5,823,631 A 10/1998 Herbolzheimer et al.
5,826,656 A 10/1998 McGuire et al.
5,860,475 A 1/1999 Ejiogu et al.
5,899,274 A 5/1999 Frauenfeld et al.
5,923,170 A 7/1999 Kuckes
5,931,230 A 8/1999 Lesage et al.
5,941,081 A 8/1999 Burgener
5,957,202 A 9/1999 Huang
5,984,010 A 11/1999 Elias et al.
6,000,471 A 12/1999 Langset
6,004,451 A 12/1999 Rock et al.
6,012,520 A 1/2000 Yu et al.
6,015,015 A 1/2000 Luft et al.
6,016,867 A 1/2000 Gregoli et al.
6,016,868 A 1/2000 Gregoli et al.
6,026,914 A 2/2000 Adams et al.
6,039,116 A 3/2000 Stevenson et al.
6,039,121 A 3/2000 Kisman
6,048,810 A 4/2000 Baychar
6,050,335 A 4/2000 Parsons
6,056,057 A 5/2000 Vinegar et al.
6,102,122 A 8/2000 de Rouffignac
6,109,358 A 8/2000 McPhee et al.
6,148,911 A 11/2000 Gipson et al.
6,158,510 A 12/2000 Bacon et al.
6,158,513 A 12/2000 Nistor et al.
6,167,966 B1 1/2001 Ayasse et al.
6,173,775 B1 1/2001 Elias et al.
6,186,232 B1 2/2001 Isaccs et al.
6,189,611 B1 2/2001 Kasevich
6,205,289 B1 3/2001 Kobro
6,230,814 B1 5/2001 Nasr et al.
6,244,341 B1 6/2001 Miller
6,257,334 B1 7/2001 Cyr et al.
6,263,965 B1 7/2001 Schmidt et al.
6,276,457 B1 8/2001 Moffatt et al.
6,285,014 B1 9/2001 Beck et al.
6,305,472 B2 10/2001 Richardson et al.
6,318,464 B1 11/2001 Mokrys
6,325,147 B1 12/2001 Doerler et al.
6,328,104 B1 12/2001 Graue
6,353,706 B1 3/2002 Bridges
6,357,526 B1 3/2002 Abdel-Halim et al.
6,405,799 B1 6/2002 Vallejos et al.
6,409,226 B1 6/2002 Slack et al.
6,412,557 B1 7/2002 Ayasse et al.
6,413,016 B1 7/2002 Nelson et al.
6,454,010 B1 9/2002 Thomas et al.
6,484,805 B1 11/2002 Perkins et al.
6,536,523 B1 3/2003 Kresnyak et al.
6,554,067 B1 4/2003 Davies et al.

(56) References Cited

U.S. PATENT DOCUMENTS 6,561,274 B1 5/2003 Hayes et al.
6,581,684 B2 6/2003 Wellington et al.
6,588,500 B2 7/2003 Lewis
6,591,908 B2 7/2003 Nasr
6,607,036 B2 8/2003 Ranson et al.
6,631,761 B2 10/2003 Yuan et al.
6,662,872 B2 12/2003 Gutek et al.
6,666,666 B1 12/2003 Gilbert et al.
6,681,859 B2 1/2004 Hill
6,688,387 B1 2/2004 Wellington et al.
6,702,016 B2 3/2004 de Rouffignac et al.
6,708,759 B2 3/2004 Leaute et al.
6,712,136 B2 3/2004 de Rouffignac et al.
6,712,150 B1 3/2004 Misselbrook et al.
6,715,546 B2 4/2004 Vinegar et al.
6,715,547 B2 4/2004 Vinegar et al.
6,715,548 B2 4/2004 Wellington et al.
6,715,549 B2 4/2004 Wellington et al.
6,719,047 B2 4/2004 Fowler et al.
6,722,429 B2 4/2004 de Rouffignac et al.
6,722,431 B2 4/2004 Karanikas et al.
6,725,920 B2 4/2004 Zhang et al.
6,729,394 B1 5/2004 Hassan et al.
6,729,395 B2 5/2004 Shahin, Jr. et al.
6,729,397 B2 5/2004 Zhang et al.
6,729,401 B2 5/2004 Vinegar et al.
6,732,794 B2 5/2004 Wellington et al.
6,732,795 B2 5/2004 de Rouffignac et al.
6,732,796 B2 5/2004 Vinegar et al.
6,733,636 B1 5/2004 Heins
6,736,215 B2 5/2004 Maher et al.
6,736,222 B2 5/2004 Kuckes et al.
6,739,394 B2 5/2004 Vinegar et al.
6,742,588 B2 6/2004 Wellington et al.
6,742,593 B2 6/2004 Vinegar et al.
6,745,831 B2 6/2004 de Rouffignac et al.
6,745,832 B2 6/2004 Wellington et al.
6,745,837 B2 6/2004 Wellington et al.
6,755,246 B2 6/2004 Chen et al.
6,758,268 B2 7/2004 Vinegar et al.
6,769,486 B2 8/2004 Lim et al.
6,782,947 B2 8/2004 de Rouffignac et al.
6,789,625 B2 9/2004 de Rouffignac et al.
6,794,864 B2 9/2004 Mirotchnik et al.
6,805,195 B2 10/2004 Vinegar et al.
6,814,141 B2 11/2004 Huh et al.
6,877,556 B2 4/2005 Wittle et al.
6,883,607 B2 4/2005 Nenniger et al.
6,962,466 B2 11/2005 Vinegar et al.
7,013,970 B2 3/2006 Collie et al.
7,056,725 B1 6/2006 Lu
7,069,990 B1 7/2006 Bilak
7,272,973 B2 9/2007 Craig
7,294,156 B2 11/2007 Chakrabarty et al.
7,322,409 B2 1/2008 Wittle et al.
7,363,973 B2 4/2008 Nenniger et al.
7,434,619 B2 10/2008 Rossi et al.
7,464,756 B2 12/2008 Gates et al.
7,527,096 B2 5/2009 Chung et al.
7,770,643 B2 8/2010 Daussin
7,918,269 B2 4/2011 Cavender et al.
7,975,763 B2 7/2011 Banerjee et al.
8,141,636 B2 3/2012 Speirs et al.
8,176,982 B2 5/2012 Gil et al.
8,215,392 B2 7/2012 Rao
8,256,511 B2 9/2012 Boone et al.
8,327,936 B2 12/2012 Coskuner
8,434,551 B2 5/2013 Nenniger et al.
8,455,405 B2 6/2013 Chakrabarty
8,474,531 B2 7/2013 Nasr et al.
8,528,642 B2 9/2013 Boone
8,596,357 B2 12/2013 Nenniger
8,602,098 B2 12/2013 Kwan et al.
8,616,278 B2 12/2013 Boone et al.
8,684,079 B2 4/2014 Wattenbarger et al.
8,752,623 B2 6/2014 Sirota et al.
8,770,289 B2 7/2014 Boone
8,776,900 B2 7/2014 Nenniger et al.
8,783,358 B2 7/2014 Critsinelis et al.
8,844,639 B2 9/2014 Gupta et al.
8,857,512 B2 10/2014 Nenniger et al.
8,899,321 B2 12/2014 Dawson et al.
8,985,205 B2 3/2015 Nenniger
9,103,205 B2 8/2015 Wright et al.
9,115,577 B2 8/2015 Alvestad et al.
9,316,096 B2 4/2016 Bang et al.
9,341,049 B2 5/2016 Hailey, Jr. et al.
9,347,312 B2 5/2016 Vincelette et al.
9,359,868 B2 6/2016 Scott
9,394,769 B2 7/2016 Nenniger
9,488,040 B2 11/2016 Chakrabarty et al.
9,506,332 B2 11/2016 Saeedfar
9,644,467 B2 5/2017 Chakrabarty
9,739,123 B2 8/2017 Wheeler et al.
9,809,786 B2 11/2017 Olson et al.
9,845,669 B2 12/2017 Miller et al.
9,951,595 B2 4/2018 Akinlade et al.
9,970,282 B2 5/2018 Khaledi et al.
9,970,283 B2 5/2018 Khaledi et al.
10,000,998 B2 6/2018 Chakrabarty et al.
10,041,340 B2 8/2018 Chakrabarty
10,094,208 B2 10/2018 Hoier et al.
10,145,226 B2 12/2018 Yee et al.
2001/0009830 A1 7/2001 Bachar
2001/0017206 A1 8/2001 Davidson et al.
2001/0018975 A1 9/2001 Richardson et al.
2002/0029881 A1 3/2002 de Rouffignac et al.
2002/0033253 A1 3/2002 de Rouffignac et al.
2002/0038710 A1 4/2002 Maher et al.
2002/0040779 A1 4/2002 Wellington et al.
2002/0046838 A1 4/2002 Karanikas et al.
2002/0056551 A1 5/2002 Wellington et al.
2002/0104651 A1 8/2002 McClung, III
2002/0148608 A1 10/2002 Shaw
2002/0157831 A1 10/2002 Kurlenya et al.
2003/0000711 A1 1/2003 Gutek et al.
2003/0009297 A1 1/2003 Mirotchnik et al.
2006/0231455 A1 10/2006 Olsvik et al.
2008/0115945 A1 5/2008 Lau et al.
2008/0153717 A1 6/2008 Pomerleau et al.
2008/0173447 A1 7/2008 Da Silva et al.
2009/0288826 A1 11/2009 Gray
2010/0258308 A1 10/2010 Speirs et al.
2010/0276140 A1 11/2010 Edmunds et al.
2010/0276341 A1 11/2010 Speirs et al.
2010/0276983 A1 11/2010 Dunn et al.
2010/0282593 A1 11/2010 Speirs et al.
2011/0229071 A1 9/2011 Vincelette et al.
2011/0272152 A1 11/2011 Kaminsky et al.
2011/0272153 A1 11/2011 Boone et al.
2011/0276140 A1 11/2011 Vresilovic et al.
2011/0303423 A1 12/2011 Kaminsky et al.
2012/0234535 A1 9/2012 Dawson et al.
2012/0285700 A1 11/2012 Scott
2013/0000896 A1 1/2013 Boone
2013/0000898 A1 1/2013 Boone
2013/0025861 A1 1/2013 Kift et al.
2013/0043025 A1 2/2013 Scott
2013/0045902 A1 2/2013 Thompson et al.
2013/0098607 A1 4/2013 Kerr
2013/0105147 A1 5/2013 Scott
2013/0112408 A1 5/2013 Oxtoby
2013/0153215 A1 6/2013 Scott et al.
2013/0153216 A1 6/2013 Scott
2013/0199777 A1 8/2013 Scott
2013/0199779 A1 8/2013 Scott
2013/0199780 A1 8/2013 Scott
2013/0206405 A1 8/2013 Kift et al.
2013/0328692 A1 12/2013 Johannessen
2014/0034305 A1 2/2014 Dawson
2014/0048259 A1 2/2014 Menard
2014/0054028 A1 2/2014 Little et al.
2014/0069641 A1 3/2014 Kosik
2014/0083694 A1 3/2014 Scott et al.

(56) References Cited

U.S. PATENT DOCUMENTS

| | | | |
|---|---|---|---|
| 2014/0083706 | A1 | 3/2014 | Scott et al. |
| 2014/0096959 | A1 | 4/2014 | Hocking |
| 2014/0144627 | A1 | 5/2014 | Salazar Hernandez et al. |
| 2014/0174744 | A1 | 6/2014 | Boone et al. |
| 2014/0251596 | A1 | 9/2014 | Gittins et al. |
| 2015/0034555 | A1 | 2/2015 | Speirs et al. |
| 2015/0053401 | A1 | 2/2015 | Khaledi et al. |
| 2015/0083413 | A1 | 3/2015 | Salazar et al. |
| 2015/0107833 | A1 | 4/2015 | Boone et al. |
| 2015/0107834 | A1 | 4/2015 | Shen et al. |
| 2015/0144345 | A1 | 5/2015 | Bilozir et al. |
| 2016/0061014 | A1 | 3/2016 | Sood et al. |
| 2016/0153270 | A1* | 6/2016 | Chen ..... E21B 43/2408 166/401 |
| 2017/0051597 | A1 | 2/2017 | Akiya et al. |
| 2017/0130572 | A1 | 5/2017 | Yuan et al. |
| 2017/0210972 | A1 | 7/2017 | Williamson et al. |
| 2017/0241250 | A1 | 8/2017 | Singh et al. |
| 2018/0030381 | A1 | 2/2018 | Olson et al. |
| 2018/0073337 | A1 | 3/2018 | Park et al. |
| 2018/0265768 | A1 | 9/2018 | Williamson |
| 2019/0002755 | A1 | 1/2019 | Wang et al. |
| 2019/0032460 | A1 | 1/2019 | Khaledi et al. |
| 2019/0032462 | A1 | 1/2019 | Motahhari et al. |
| 2019/0063199 | A1 | 2/2019 | Doraiswamy et al. |
| 2019/0119577 | A1 | 4/2019 | Witham et al. |
| 2019/0120043 | A1 | 4/2019 | Gupta et al. |

FOREIGN PATENT DOCUMENTS

| | | | |
|---|---|---|---|
| CA | 0852003 | A | 9/1970 |
| CA | 0956885 | A | 10/1974 |
| CA | 0977675 | A | 11/1975 |
| CA | 1015656 | A | 8/1977 |
| CA | 1027851 | A | 3/1978 |
| CA | 1059432 | A | 7/1979 |
| CA | 1061713 | A | 9/1979 |
| CA | 1072442 | A | 2/1980 |
| CA | 1295118 | C | 2/1992 |
| CA | 1300000 | C | 5/1992 |
| CA | 2108723 | A1 | 4/1995 |
| CA | 2108349 | C | 8/1996 |
| CA | 2369244 | C | 4/2005 |
| CA | 2147079 | C | 10/2006 |
| CA | 2235085 | C | 1/2007 |
| CA | 2281276 | C | 2/2007 |
| CA | 2647973 | A1 | 10/2007 |
| CA | 2304938 | C | 2/2008 |
| CA | 2299790 | C | 7/2008 |
| CA | 2633061 | A1 | 7/2008 |
| CA | 2374115 | C | 5/2010 |
| CA | 2652930 | A1 | 7/2010 |
| CA | 2621991 | C | 9/2010 |
| CA | 2660227 | A1 | 9/2010 |
| CA | 2730875 | A1 | 8/2012 |
| CA | 2971941 | A1 | 12/2012 |
| CA | 2436158 | C | 6/2013 |
| CA | 2553297 | C | 7/2013 |
| CA | 2654848 | C | 10/2013 |
| CA | 2777966 | A1 | 11/2013 |
| CA | 2781273 | C | 5/2014 |
| CA | 2804521 | A1 | 7/2014 |
| CA | 2917260 | A1 | 1/2015 |
| CA | 2917263 | A1 | 1/2015 |
| CA | 2841520 | A1 | 2/2015 |
| CA | 2785871 | C | 5/2015 |
| CA | 2691399 | C | 9/2015 |
| CA | 2847759 | A1 | 9/2015 |
| CA | 2893170 | A1 | 11/2015 |
| CA | 2853445 | A1 | 12/2015 |
| CA | 2854171 | A1 | 12/2015 |
| CA | 2898065 | A1 | 1/2016 |
| CA | 2962274 | A1 | 1/2016 |
| CA | 2890491 | A1 | 2/2016 |
| CA | 2893221 | C | 4/2016 |
| CA | 2872120 | A1 | 5/2016 |
| CA | 2875846 | C | 5/2016 |
| CA | 2900179 | C | 5/2016 |
| CA | 2898943 | C | 6/2016 |
| CA | 2897785 | C | 7/2016 |
| CA | 2900178 | C | 9/2016 |
| CA | 2707776 | C | 11/2016 |
| CA | 2893552 | C | 11/2016 |
| CA | 2935652 | A1 | 1/2017 |
| CA | 2857329 | C | 2/2017 |
| CA | 2915571 | C | 2/2017 |
| CA | 2856460 | C | 5/2017 |
| CA | 2956771 | A1 | 8/2017 |
| CA | 2981619 | A1 | 12/2017 |
| CA | 2875848 | C | 5/2018 |
| CA | 2899805 | C | 5/2018 |
| CA | 2928044 | C | 7/2018 |
| CA | 2974714 | C | 9/2018 |
| CA | 2965117 | A1 | 10/2018 |
| CA | 2958715 | C | 3/2019 |
| CN | 101870894 | | 4/2009 |
| EP | 0144203 | A2 | 6/1985 |
| EP | 0261793 | A1 | 3/1988 |
| EP | 0283602 | A1 | 9/1988 |
| EP | 0747142 | B1 | 4/2001 |
| FR | 2852713 | | 9/2004 |
| GB | 1457696 | A | 12/1976 |
| GB | 1463444 | A | 2/1977 |
| GB | 2156400 | A | 10/1985 |
| GB | 2164978 | A | 4/1986 |
| GB | 2286001 | B | 10/1995 |
| GB | 2357528 | A | 6/2001 |
| GB | 2391890 | A | 2/2004 |
| GB | 2391891 | A | 2/2004 |
| GB | 2403443 | A | 1/2005 |
| KR | 20130134846 | | 5/2012 |
| WO | 1982/01214 | A1 | 4/1982 |
| WO | 1989/12728 | A1 | 12/1989 |
| WO | 1994/21889 | A3 | 9/1994 |
| WO | 1999/67503 | A1 | 12/1999 |
| WO | 2000/25002 | A1 | 5/2000 |
| WO | 2000/66882 | A1 | 11/2000 |
| WO | 2001/81239 | A2 | 11/2001 |
| WO | 2001/81715 | A2 | 11/2001 |
| WO | 2001/92673 | A2 | 12/2001 |
| WO | 2001/92768 | A2 | 12/2001 |
| WO | 2002/086018 | A2 | 10/2002 |
| WO | 2002/086276 | A2 | 10/2002 |
| WO | 2003/010415 | A1 | 2/2003 |
| WO | 2003/036033 | A1 | 5/2003 |
| WO | 2003/036038 | A2 | 5/2003 |
| WO | 2003/036039 | A1 | 5/2003 |
| WO | 2003/036043 | A2 | 5/2003 |
| WO | 2003/038233 | A1 | 5/2003 |
| WO | 2003/040513 | A2 | 5/2003 |
| WO | 2003/062596 | A1 | 7/2003 |
| WO | 2004/038173 | A1 | 5/2004 |
| WO | 2004/038174 | A2 | 5/2004 |
| WO | 2004/038175 | A1 | 5/2004 |
| WO | 2004/050567 | A1 | 6/2004 |
| WO | 2004/050791 | A1 | 6/2004 |
| WO | 2004/097159 | A3 | 11/2004 |
| WO | 2005/012688 | A1 | 2/2005 |
| WO | 2015/158371 | A1 | 10/2015 |
| WO | 2017/222929 | A1 | 12/2017 |

OTHER PUBLICATIONS

Andrade, M.R., et al. (2007), "Mixotrophic cultivation of microalga Spirulina platensis using molasses as organic substrate", *Aquaculture*, vol. 264, pp. 130-134.

Bayestehparvin, B., et al. (2015) "Dissolution an dMobilization of Bitumen at Pore Scale", *SPE174482-MS, Prepared for presentation at the SPE Canada Heavy Oil Technical Conference* held in Calgary, Alberta, Canada, Jun. 9-11, 2015; 23 pages.

(56) References Cited

OTHER PUBLICATIONS

Butler, R. M. et al. (1991) "A new process (VAPEX) for recovering heavy oils using hot water and hydrocarbon vapour", *CIM/SPE Annual Technical Conference* Jan.-Feb. vol. 30, No. 1, pp. 97-106.
Butler, R. M. et al. (1993) "Recovery of Heavy Oils Using Vapourized Hydrocarbon Solvents: Further Development of the Vapex Process" *The Journal of Canadian Petroleum Technology*, Jun., vol. 32, No. 6, pp. 56-64.
Castanier, L.M., et al. (2005) "Heavy oil upgrading in-situ via solvent injection and combustion: A "new" method", *EAGE 67th Conference & Exhibition*—Madrid, Spain, Jun. 13-16, 2005; 4 pages.
Cristofari, J., et al. (2008) "Laboratory Investigation of the Effect of Solvent Injection on In-Situ Combustion" SPE 99752 prepared for presentation at the 2006 SPE/DOE Symposium on Improved Oil Recovery, Tulsa, Apr. 22-26. 11 pages.
Cunha, L.B. (2005) "Recent In-Situ Oil Recovery-Technologies for Heavy- and Extraheavy-Oil Reserves", SPE 94986, prepared for presentation at the 2005 SPE Latin American and Caribbean Petroleum Enginerring Conference held in Rio de Janeiro, Brazil, Jun. 20-23; 5 pages.
Deng, X (2005) "Recovery Performance and Economics of Steam/Propane Hybrid Process." SPE/PS-CIM/CHOA 97760, PS2005-341, SPE/PS-CIM/CHOA International Thermal Operations and Heavy Oil Symposium, copyright, pp. 1-7.
Diaz, J. A. D. (2006) "An Experimental Study of Steam and Steam-Propane Injection Using a Novel Smart Horizontal Producer to Enhance Oil Production in the San Ardo Field." Presentation given at Sponsor's Meeting, Crisman Institute, Aug. 3, Department of Petroleum Engineering, Texas A&M University (7 pages).
Doan, Q., et al. (2011) "Potential Pitfalls From Successful History-Match Simulation of a Long-Running Clearwater-Fm Sagd Well Pair" SPE 147318, Prepared for presentation at the SPE Annual Technical Conference and Exhibition held in Denver, Colorado, Oct. 30-Nov. 2; 9 pages.
D'Silva, J, et al. (2008) "In-Situ Combustion With Solvent Injection" SPE 117684, Prepared for presentation at the SPE International Thermal Operations and Heavy Oil Symposium held in Calgary, Alberta, Canada, Oct. 20-23; 11 pages.
D'Silva, J., et al. (2011) "Integration of In-Situ Combustion With Solvent Injection—A Detailed Study" SPE 141570, Prepared for presentation at the SPE Projects and Facilities Challenges Conference at METS held in Doha, Qatar, Feb. 13-16; 11 pages.
Dunn-Norman, S., et al. (2002) "Recovery Methods for Heavy Oil in Ultra-Shallow Reservoirs" SPE 76710, prepared for presentation at the SPE Western Regional/AAPG Pacific Section Joint Meeting held in Anchorage, Alaska, May 20-22, 6 pages.
Frauenfeld, T.W., et al (2006) "Economic Analysis of Thermal Solvent Processes" Pet-Soc 2006-164; Presented at the Petroleum Socity's 7th Canadian International Peteroleum Conference (57th Annual Technical Meeting), Calgary, Alberta, Canada, Jun. 13-15, 2006; 9 pages.
Gates, I.D., et al. (2011) "Evolution of in Situ Oil Sands Recovery Technology: What Happened and What's New?" SPE150686, Prepared for presentation at the SPE Heavy Oil Conference and Exhibition held in Kuwait City, Kuwait, Dec. 12-14, 2011; 10 pages.
Ghoodjani, E., et al. (2012) "A Review on Thermal Enhanced Heavy Oil Recovery From Fractured Carbonate Reservoirs" SPE 150147, Prepared for presentation at the SPE Heavy Oil Conference Canada held in Calgary, Alberta, Canada, Jun. 12-14, 2012; 8 pages.
Goldthorpe, S. (2013) "Cement Plant CO2 to DME," *IEAGHG Information Paper*; 2013-IP9, Jun. 2013, 1 page.
Greaser, G.R., et al. (2003) "New Thermal Recovery Tech nology and Technology Transfer for Successful Heavy Oil Development." SPE69731, *Society of Petroleum Engineers*, Inc., 7 pages.
Hong, K.C. (1999) "Recent Advances in Steamflood Technology." SPE 54078, Copyright 1999, Society of Petroleum Engineers, Inc., 14 pages.
Jaiswal, N. J. (2006) "Experimental and Analytical Studies of Hydrocarbon Yields Under Dry-, Steam-, and Steam with Propane-Distillation." Presentation given at Crisman Institute's Halliburton Center for Unconventional Resources, Aug. 3, 2006, Department of Petroleum Engineering, Texas A&M University (5 pages).
Jiang, Q., et al. (2010) "Evaluation of Recovery Technologies for the Grosmont Carbonate Reservoirs" *Journal of Canadian Petroleum Technology*, vol. 49, No. 5, pp. 56-64.
Kamal, C., et al. (2012), "Spirulina platensis—A novel green inhibitor for acid corrosion of mild steel", *Arabian Journal of Chemistry*, vol. 5, pp. 155-161.
Khaledi, R., et al. (2018) "Azeotropic Heated Vapour Extraction—A New Thermal-Solvent Assisted Gravity Drainage Recovery Process", SPE189755-MS, SPE Canada Heavy Oil Technical Conference held in Calgary, Alberta, Canada, Mar. 13-14, 2018, 20 pages.
Lei, H., et al. (2012) "An Evaluation of Air Injection As a Follow-Up Process to Cyclic Steam Stimulation in a Heavy Oil Reservoir" SPE 150703, Prepared for presentation at the SPE Heavy Oil Conference Canada held in Calgary, Alberta, Canada, Jun. 12-14, 2012; 13 pages.
Lennox, T.R. et al (1980) "Geology of in Situ Pilot Project, Wabasca Oil Sands Deposit, Alberta" *Saskatchewan Geological Society Special Publication No. 5*; Conference and Core Seminar, Regina, Oct. 15-17, 1980; pp. 267-268.
Lim, G.B. et al. (1994) "Three Dimensional Scaled Physcial Modeling of Solvent Vapour Extraction of Cold Lake Bitumen," *Canadian SPE Int'l Conf. on Recent Advances in Horizontal Well Applications*, Paper No. HWC94-46, Calgary, Canada, Mar. 20-23, 1994, 11 pages.
Lim, G.B. et al. (1995) "Cyclic Stimulation of Cold Lake Oil Sand with Supercriticall Ethane," SPE #30298, Int'l Heavy Oil Symposium, Calgary, Alberta, Canada, Jun. 19-21, 1995, pp. 521-528.
Lyubovsky, M., et al. (2005) "Catalytic Partial 'Oxidation of Methane to Syngas' at Elevated Pressures," *Catalysis Letters*, v. 99, Nos. 3-4, Feb. 2005, pp. 113-117.
Mamora, D. D., (2006) "Thermal Oil Recovery Research at Texas A&M in the Past Five Years—an Overview." Presentation given at the Crisman Institute Halliburton Center for Unconventional Resources, Research Meeting Aug. 3, Department of Petroleum Engineering, Texas A&M University (13 pages).
Mert, B.D., et al. (2011) "The role of Spirulina platensis on corrosion behavior of carbon steel", *Materials Chemistry and Physics*, vol. 130, pp. 697-701.
Mokrys, I. J., et al. (1993) "In-Situ Upgrading of Heavy Oils andBitumen by Propane Deasphalting: The Vapex Process" SPE 25452, Mar. 21-23, Oklahoma City, OK, pp. 409-424.
Mulac, A.J., et al. (1981) "Project Deep Steam Preliminary Field Test Bakersfield, California." SAND80-2843, Printed Apr. 62 pages.
Naderi, K., et al. (2015) "Effect of Bitumen Viscosity and Bitumen—Water Interfacial Tension on Steam Assisted Bitumen Recovery Process Efficiency", *Journal of Petroleum Science and Engineering* 133, pp. 862-868.
Nasr, T.N., et al. (2005) "Thermal Techniques for the Recovery of Heavy Oil and Bitumen" SPE 97488 prepared for presentation at the SPE International Improved Oil Recovery Conferencein Asia Pacific held in Kuala Lumpur, Malaysia, Dec. 5-6, 2005. 15 pages.
Nasr, T.N. et al. (2006) "New Hybrid Steam-Solvent Processes for the Recovery of Heavy Oil and Bitumen" SPE 101717 Prepared for presentation at the Abu Dhabi International Petroleum Exhibition and Conference held in Abu Dhabi, U.A.E., Nov. 5-8, 2006; 17 pages.
National Energy Board, (2004) "Canada's Oil Sands. Opportunities and Challenges to 2015." An Energy Market Assessment, May (158 pages).
Nexant, Inc. (2008), "Dimethyl Ether Technology and Markets," CHEMSystems PERP Program Report 07/08S3, Dec. 2008, 7 pages.
NTIS, Downhole Steam-Generator Study, vol. 1, Conception and Feasibility Evaluation. Final Report, Sep. 1978-Sep. 1980, Sandia National Labs, Albuquerque NM, Jun. 1982. 260 pages.
Oceaneering; Website: http://www.oceaneering.com/Brochures/MFX%20%Oceaneering%20Multiflex.pdf, Oceaneering Multiflex, Oceaneering International, Incorporated, printed Nov. 23, 2005, 2 pages.

(56) References Cited

OTHER PUBLICATIONS

Qi, G.X. et al. (2001) "DME Synthesis from Carbon Dioxide and Hydrogen Over Cu-Mo/HZSM-5," *Catalysis Letters*, V. 72, Nos. 1-2, 2001, pp. 121-124.

Redford, et al. (1980) "Hydrocarbon-Steam Processes for Recovery of Bitumen from Oil Sands" SPE8823, Prepared for presentation at the First Joint SPE/DOE Symposium on Enhanced Oil Recovery at Tulsa, Oklahoma, Apr. 20-23; 12 pages.

Saeedfar, A., et al. (2018) "Critical Consideration for Analysis of RF-Thermal Recovery of Heavy Petroleum" SPE-189714-MS, Prepared for presentation at the SPE Canada Heavy Oil Technical Conference held in Calgary, Alberta, Canada, Mar. 13-14, 2018; 13 pages.

Seibert, B. H. (2012) "Sonic Azeotropic Gravity Extraction of Heavy Oil From Oil Sands", SPE157849-MS, SPE Heavy Oil Conference Canda held in Calgary, Alberta, Canada, Jun. 12-14, 2012, 10 pages.

Sharma, J. et al. (2010) "Steam-Solvent Coupling At the Chamber Edge in an in Situ Bitumen Recovery Process" SPE 128045, Prepared for presentation at the SPE Oil and Gas India Conference and Exhibition held in Mumbai, India Jan. 10-22; 26 pages.

Stark, S.D. (2013) "Cold Lake Commercialization of the Liquid Addition to Steam for Enhancing Recovery (Laser) Process" IPTC 16795, Prepared for presentation at the International Petroleum Technology Conference held in Beijing, China, Mar. 26-28, 2013, 15 pages.

Wan Nik, W.B., et al. (2012), "Marine Extracts as Corrosion Inhibitor for Aluminum in Seawater Applications", *International Journal of Engineering Research and Applications* (IJERA), vol. 2, Issue 1; pp. 455-458.

Zhang, L. et al. (2013) "Dehydration of Methanol to Dimethyl Ether Over y—AL2O3 Catalyst: Intrinsic Kinetics and Effectiveness Factor," *Canadian Journal of Chem. Engineering*, v.91, Sep. 2013, pp. 1538-1546.

International Search Report and the Written Opinion of the International Searching Authority, or the Declaration (2 pages), International Search Report (4 pages), and Written Opinion of the International Searching Authority (6 pages) for International Application No. PCT/US2007/080985 dated Feb. 28, 2008.

International Preliminary Report on Patentability (2 pages); Written Opinion of the International Searching Authority (6 pages); all dated Apr. 23, 2009 in PCT International Application No. PCT/US2007/080985, filed Oct. 10, 2007 (Total 8 pages).

* cited by examiner

ENHANCED METHODS FOR RECOVERING VISCOUS HYDROCARBONS FROM A SUBTERRANEAN FORMATION AS A FOLLOW-UP TO THERMAL RECOVERY PROCESSES

CROSS-REFERENCE TO RELATED APPLICATION

This application claims priority from Canadian Patent Application 2,974,712 filed Jul. 27, 2017 entitled ENHANCED METHODS FOR RECOVERING VISCOUS HYDROCARBONS FROM A SUBTERRANEAN FORMATION AS A FOLLOW-UP TO THERMAL RECOVERY PROCESSES, the entirety of which is incorporated by reference herein.

FIELD OF THE DISCLOSURE

The present disclosure relates generally to methods for recovering viscous hydrocarbons from a subterranean formation and more particularly to methods that utilize a solvent flood vapor stream to recover the viscous hydrocarbons from the subterranean formation subsequent to performing a thermal recovery process within the subterranean formation.

BACKGROUND OF THE DISCLOSURE

Hydrocarbons often are utilized as fuels and/or as chemical feedstocks for manufacturing industries. Hydrocarbons naturally may be present within subterranean formations, which also may be referred to herein as reservoirs and/or as hydrocarbon reservoirs. Such hydrocarbons may occur in a variety of forms, which broadly may be categorized herein as conventional hydrocarbons and unconventional hydrocarbons. A process utilized to remove a given hydrocarbon from a corresponding subterranean formation may be selected based upon one or more properties of the hydrocarbon and/or of the subterranean formation.

As an example, conventional hydrocarbons generally have a relatively lower viscosity and extend within relatively higher fluid permeability subterranean formations. As such, these conventional hydrocarbons may be pumped from the subterranean formation utilizing a conventional oil well.

As another example, unconventional hydrocarbons generally have a relatively higher viscosity and/or extend within relatively lower fluid permeability subterranean formations. As such, a conventional oil well may be ineffective at producing unconventional hydrocarbons. Instead, unconventional hydrocarbon production techniques may be utilized.

Examples of unconventional hydrocarbon production techniques that may be utilized to produce viscous hydrocarbons from a subterranean formation include thermal recovery processes. Thermal recovery processes generally inject a thermal recovery stream, at an elevated temperature, into the subterranean formation. The thermal recovery stream contacts the viscous hydrocarbons, within the subterranean formation, and heats, dissolves, and/or dilutes the viscous hydrocarbons, thereby generating mobilized viscous hydrocarbons. The mobilized viscous hydrocarbons generally have a lower viscosity than a viscosity of the naturally occurring viscous hydrocarbons at the native temperature and pressure of the subterranean formation and may be pumped and/or flowed from the subterranean formation. A variety of different thermal recovery processes have been utilized, including cyclic steam stimulation processes, solvent-assisted cyclic steam stimulation processes, steam flooding processes, solvent-assisted steam flooding processes, steam-assisted gravity drainage processes, solvent-assisted steam-assisted gravity drainage processes, heated vapor extraction processes, liquid addition to steam to enhance recovery processes, and/or near-azeotropic gravity drainage processes.

Thermal recovery processes may differ in the mode of operation and/or in the composition of the thermal recovery stream. However, all thermal recovery processes rely on injection of the thermal recovery stream into the subterranean formation at the elevated temperature, and thermal contact between the thermal recovery stream and the subterranean formation heats the subterranean formation. Thus, and after performing a given thermal recovery process within a given subterranean formation, a significant amount of thermal energy may be stored within the subterranean formation, and it may be costly to maintain the temperature of the subterranean formation and/or to heat the thermal recovery stream prior to injection of the thermal recovery stream within the subterranean formation.

In addition, as the viscous hydrocarbons are produced from the subterranean formation, an amount of energy required to produce viscous hydrocarbons increases due to increased heat loss within the subterranean formation. Similarly, a ratio of a volume of the thermal recovery stream provided to the subterranean formation to a volume of mobilized viscous hydrocarbons produced from the subterranean formation also increases. Both of these factors decrease economic viability of thermal recovery processes late in the life of a hydrocarbon well and/or after production and recovery of a significant fraction of the original oil-in-place from a given subterranean formation. Thus, there exists a need for improved methods of recovering viscous hydrocarbons from a subterranean formation.

SUMMARY OF THE DISCLOSURE

Enhanced methods for recovering viscous hydrocarbons from a subterranean formation as a follow-up to thermal recovery processes. The methods include injecting a solvent flood vapor stream into a first thermal chamber, which extends within the subterranean formation, via a solvent flood injection well that extends within the first thermal chamber. The injecting includes injecting to generate solvent flood-mobilized viscous hydrocarbons within the subterranean formation. The methods also include, at least partially concurrently with the injecting, producing the solvent flood-mobilized viscous hydrocarbons from a second thermal chamber, which extends within the subterranean formation, via a solvent flood production well that extends within the second thermal chamber. The first thermal chamber was formed via a first thermal recovery process that injected a first thermal recovery stream into the subterranean formation, and the second thermal chamber was formed via a second thermal recovery process that injected a second thermal recovery stream into the subterranean formation. The first thermal chamber and the second thermal chamber are in fluid communication with one another and define an interface region therebetween. A solvent flood stream dew point temperature of the solvent flood vapor stream is less than a first thermal recovery stream dew point temperature of the first thermal recovery stream and also is less than a second thermal recovery stream dew point temperature of the second thermal recovery stream.

DETAILED DESCRIPTION OF THE EMBODIMENTS

Figure 1:
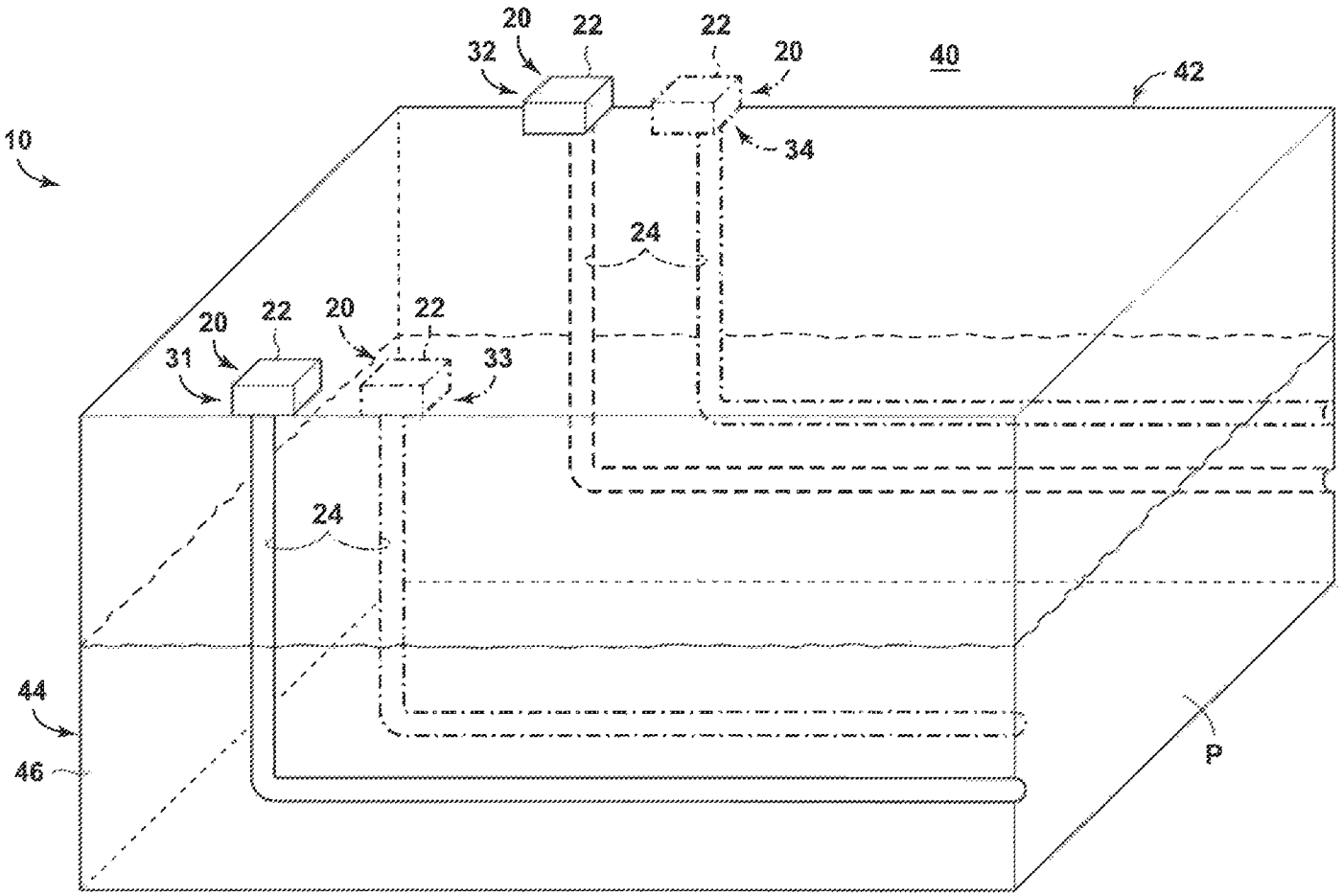
FIG. 1 is a schematic representation of examples of a hydrocarbon production system that may include and/or be utilized with methods, according to the present disclosure.

FIGS. 1-8 provide examples of hydrocarbon production systems 10, of methods 200, and/or of data that may be utilized by and/or produced during performance of methods 200. Elements that serve a similar, or at least substantially similar, purpose are labeled with like numbers in each of FIGS. 1-8, and these elements may not be discussed in detail herein with reference to each of FIGS. 1-8. Similarly, all elements may not be labeled in each of FIGS. 1-8, but reference numerals associated therewith may be utilized herein for consistency. Elements, components, and/or features that are discussed herein with reference to one or more of FIGS. 1-8 may be included in and/or utilized with any of FIGS. 1-8 without departing from the scope of the present disclosure. In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

Figure 2:
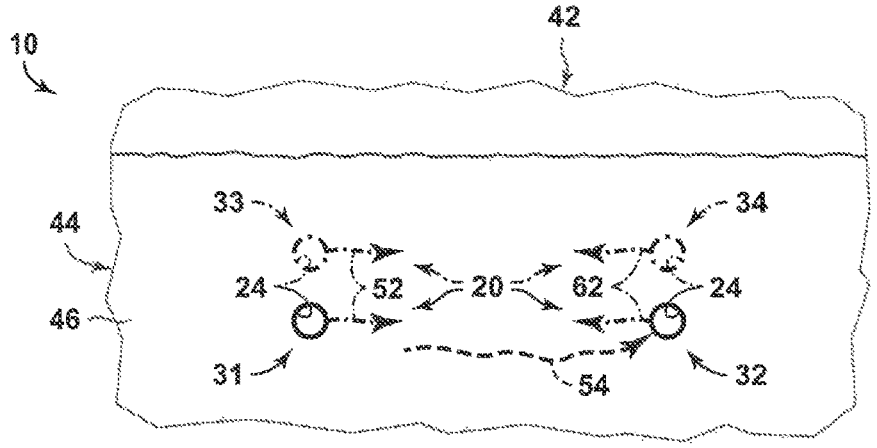
FIG. 2 is a schematic cross-sectional view of the hydrocarbon production system of FIG. 1.
Figure 3:
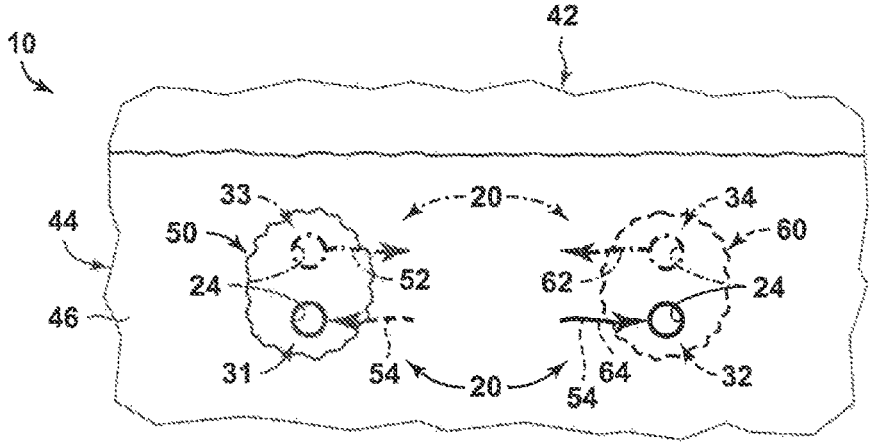
FIG. 3 is another schematic cross-sectional view of the hydrocarbon production system of FIG. 1.
Figure 4:
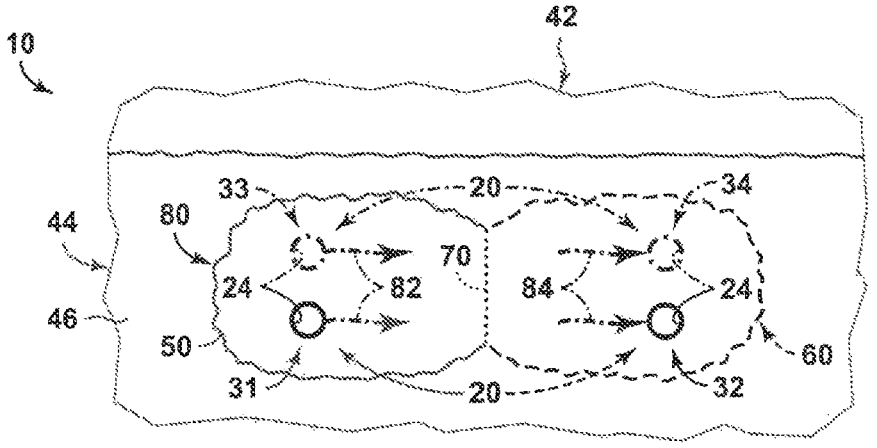
FIG. 4 is another schematic cross-sectional view of the hydrocarbon production system of FIG. 1.
Figure 5:
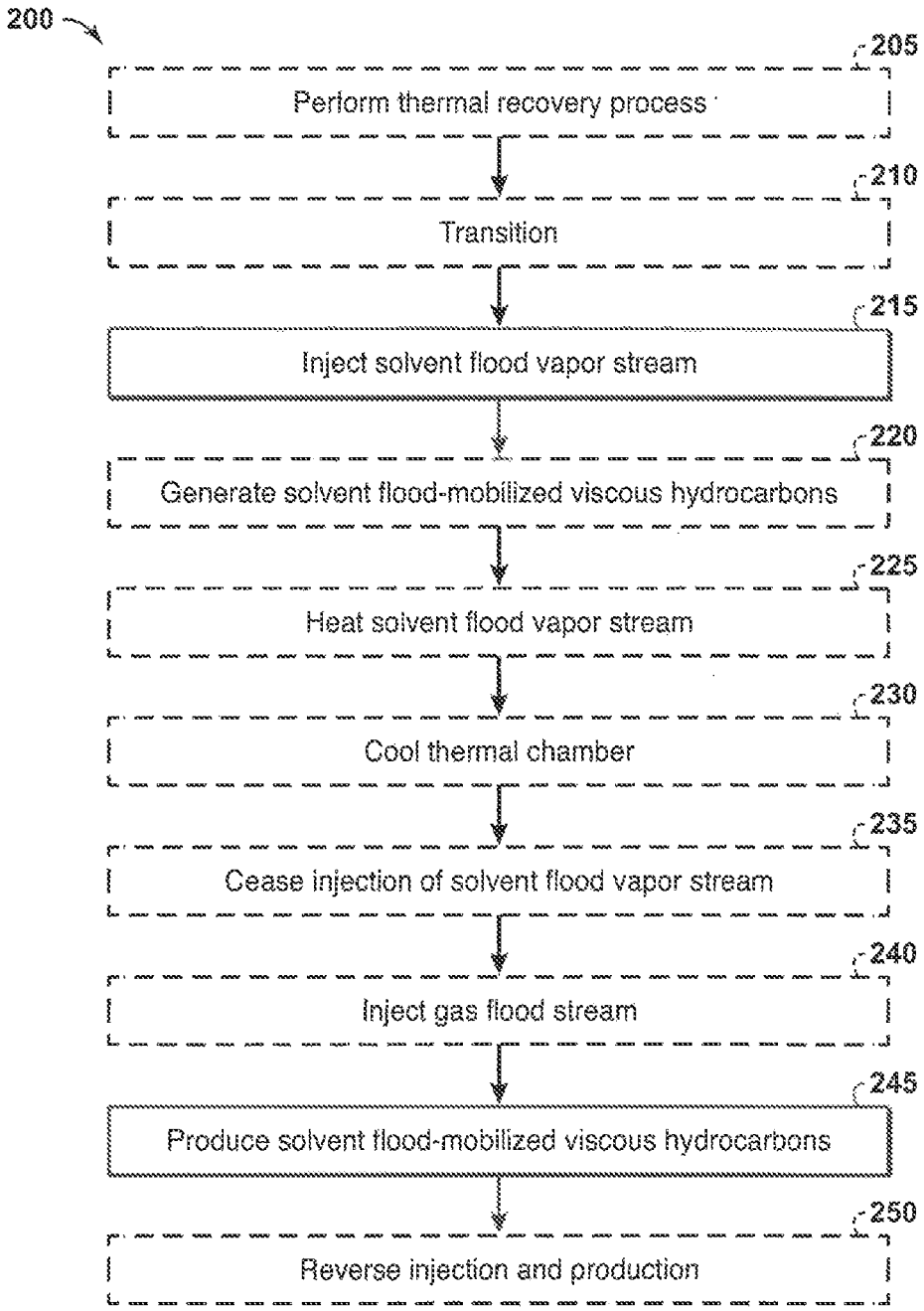
FIG. 5 is a flowchart depicting methods, according to the present disclosure, for recovering viscous hydrocarbons from a subterranean formation

FIG. 1 is a schematic representation of examples of a hydrocarbon production system 10 that may include and/or may be utilized with methods according to the present disclosure, such as methods 200 of FIG. 5. FIGS. 2-4 are schematic cross-sectional views of hydrocarbon production system 10 taken along plane P of FIG. 1.

As illustrated collectively by FIGS. 1-4, hydrocarbon production systems 10 include a plurality of spaced-apart hydrocarbon wells 20. Each hydrocarbon well 20 includes a corresponding wellhead 22 and a corresponding wellbore 24. Wellbores 24 extend within a subterranean formation 44 that includes viscous hydrocarbons 46. Wellbores 24 also may be referred to herein as extending within a subsurface region 42 and/or as extending between a surface region 40 and the subterranean formation.

As used herein, the phrase "subterranean formation" may refer to any suitable portion of the subsurface region that includes viscous hydrocarbons and/or from which mobilized viscous hydrocarbons may be produced utilizing the methods disclosed herein. In addition to the viscous hydrocarbons, the subterranean formation also may include other subterranean strata, such as sand and/or rocks, as well as lower viscosity hydrocarbons, natural gas, and/or water. The subterranean strata may form, define, and/or be referred to herein as a porous media, and the viscous hydrocarbons may be present, or may extend, within pores of the porous media.

As used herein, the phrase, "viscous hydrocarbons" may refer to any carbon-containing compound and/or compounds that may be naturally occurring within the subterranean formation and/or that may have a viscosity that precludes their production, or at least economic production, utilizing conventional hydrocarbon production techniques and/or conventional hydrocarbon wells. Examples of such viscous hydrocarbons include heavy oils, oil sands, and/or bitumen.

System 10 may include any suitable number and/or combination of hydrocarbon wells 20. As an example, and as illustrated in solid lines in FIGS. 1-4, system 10 generally includes a first hydrocarbon well 31. As another example, and as illustrated in both dashed and solid lines in FIG. 1 and in solid lines in FIGS. 2-4, system 10 also generally includes at least a second hydrocarbon well 32. As additional examples, and as illustrated in dash-dot lines in FIGS. 1-4, system 10 may include a third hydrocarbon well 33 and/or a fourth hydrocarbon well 34.

As discussed in more detail herein, it is within the scope of the present disclosure that system 10 additionally or alternatively may include a plurality of spaced-apart hydrocarbon wells 20 and that FIGS. 1-4 only may illustrate a subset, or fraction, of the plurality of spaced-apart hydrocarbon wells 20. As examples, system 10 may include at least 2, at least 4, at least 6, at least 8, at least 10, at least 15, at least 20, at least 30, or at least 40 spaced-apart hydrocarbon wells 20.

Methods 200 of FIG. 5 may be configured to be performed, such as utilizing system 10 of FIGS. 1-4, subsequent to one or more thermal recovery processes being performed by system 10. An example of such thermal recovery processes includes a single-well thermal recovery process in which a single hydrocarbon well 20 is utilized to cyclically provide a thermal recovery stream to the subterranean formation and receive a mobilized viscous hydrocarbon stream from the subterranean formation. Examples of single-well thermal recovery processes include cyclic steam stimulation and solvent-assisted cyclic steam stimulation.

An example of such a single-well thermal recovery process is illustrated in FIGS. 2-4. In a single-well thermal recovery process, system 10 may include two spaced-apart hydrocarbon wells 20, such as first hydrocarbon well 31 and second hydrocarbon well 32. As illustrated in FIG. 2, first hydrocarbon well 31 may be utilized to inject a first thermal recovery steam 52 into the subterranean formation, and second hydrocarbon well 32 may be utilized to inject a second thermal recovery steam 62 into the subterranean formation. The thermal recovery streams may be injected for corresponding injection times. Subsequently, and as illustrated in FIG. 3, injection of the thermal recovery streams may cease, first hydrocarbon well 31 may be utilized to produce a first mobilized viscous hydrocarbon stream 54 from the subterranean formation, and second hydrocarbon well 32 may be utilized to produce a second mobilized viscous hydrocarbon stream 64 from the subterranean formation. This cycle of injection and production may be repeated any suitable number of times.

The single-well thermal recovery process that is performed utilizing first hydrocarbon well 31 may produce and/or generate a first thermal chamber 50 within the subterranean formation. Similarly, the single-well thermal recovery process that is performed utilizing second hydrocarbon well 32 may produce and/or generate a second thermal chamber 60 within the subterranean formation. First thermal chamber 50 and second thermal chamber 60 may grow, expand, and/or increase in volume over an operational lifetime of system 10 and/or responsive to repeated cycles of injection and subsequent production. Eventually, and as illustrated in FIG. 4, fluid communication may be established between the first thermal chamber and the second thermal chamber, such as at an interface region 70 therebetween. Such a configuration of thermal chambers in fluid communication with each other also may be referred to herein collectively as a communicating thermal chamber 80.

As used herein, the phrase "thermal chamber," including first thermal chamber 50 and/or second thermal chamber 60, may refer to any suitable region of the subterranean formation within which injection of a corresponding thermal recovery stream and production of a corresponding mobilized viscous hydrocarbon stream has depleted, at least substantially depleted, and/or depleted a producible fraction of, naturally occurring viscous hydrocarbons.

It is within the scope of the present disclosure that the two single-well thermal recovery processes described above may have any suitable temporal relationship that leads to the formation of communicating thermal chamber 80. As examples, the single-well thermal recovery process performed utilizing first hydrocarbon well 31 and the single-well thermal recovery process performed utilizing second hydrocarbon well 32 may be performed concurrently, at least partially concurrently, sequentially, and/or at least partially sequentially.

Another example of thermal recovery processes includes a well pair thermal recovery process in which a pair of hydrocarbon wells 20 is utilized to concurrently, continuously, and/or at least substantially continuously provide a thermal recovery stream to the subterranean formation and also to receive a mobilized viscous hydrocarbon stream from the subterranean formation. Examples of well pair thermal recovery processes include steam flooding processes, solvent-assisted steam flooding processes, steam-assisted gravity drainage processes, solvent-assisted steam-assisted gravity drainage processes, heated vapor extraction processes, and/or near-azeotropic gravity drainage processes.

An example of such a well pair thermal recovery process also is illustrated in FIGS. 2-4 for a gravity drainage-type well pair thermal recovery process. In this example, system 10 may include two spaced-apart pairs of hydrocarbon wells 20. These may include a first pair, which includes first hydrocarbon well 31 and third hydrocarbon well 33 and a second pair, which includes second hydrocarbon well 32 and fourth hydrocarbon well 34. Within the first pair, first hydrocarbon well 31 may be positioned, within the subterranean formation, vertically below third hydrocarbon well 33. Similarly, within the second pair, second hydrocarbon well 32 may be positioned, within the subterranean formation, vertically below fourth hydrocarbon well 34.

As illustrated in FIG. 2, in a gravity drainage-type well pair thermal recovery process, third hydrocarbon well 33 may be utilized to inject first thermal recovery stream 52 into the subterranean formation, and fourth hydrocarbon well 34 may be utilized to inject second thermal recovery stream 62 into the subterranean formation. The thermal recovery streams may be injected continuously, or at least substantially continuously, and may interact with viscous hydrocarbons 46, which are present within the subterranean formation, to produce and/or generate corresponding mobilized viscous hydrocarbon streams.

Concurrently, at least partially concurrently, sequentially, and/or at least partially sequentially, and as illustrated in FIG. 3, first hydrocarbon well 31 may be utilized to produce first mobilized viscous hydrocarbon stream 54 from the subterranean formation, and second hydrocarbon well 32 may be utilized to produce second mobilized viscous hydrocarbon stream 64 from the subterranean formation. This process may be performed for any suitable injection time period and/or for any suitable production time period. Injection of the thermal recovery streams and production of the mobilized viscous hydrocarbon streams may produce and/or generate first thermal chamber 50 and second thermal chamber 60 within the subterranean formation.

Similar to single-well thermal recovery processes, the thermal chambers may grow with time, eventually forming, producing, and/or generating communicating thermal chamber 80 that is illustrated in FIG. 4. Furthermore, and as discussed, hydrocarbon production system 10 may include more than two pairs of spaced-apart wellbores, and thus may create more than two such thermal chambers that may grow to form part of communicating thermal chamber 80. As an example, two pairs of spaced-apart single wellbores and/or well pairs may be a part of greater repeating patterns of wellbores and/or well pair locations that may be systematically located to facilitate production and recovery of viscous hydrocarbons from the subterranean formation over an extended area. Thus, the schematic examples of one or two thermal chambers should not constrain the scope of the present disclosure to only these illustrative examples.

Another example of a well pair thermal recovery process, in the form of a steam flooding process and/or a solvent-assisted steam flooding process, also is illustrated in FIGS. 2-4. These processes generally may be referred to herein as flooding processes. In the example of flooding processes, system 10 may include a plurality of spaced-apart hydrocarbon wells 20, only two of which are illustrated schematically in FIGS. 2-4 but any number of which may be present and/or utilized in system 10. These may include first hydrocarbon well 31, which also may be referred to herein as an injection well, and second hydrocarbon well 32, which also may be referred to herein as a production well.

As illustrated in FIG. 2, in the flooding processes, first hydrocarbon well 31 may be utilized to inject first thermal recovery stream 52 into the subterranean formation. First thermal recovery stream 52 may interact with viscous hydrocarbons 46, which are present within the subterranean formation, to produce and/or generate a first mobilized viscous hydrocarbon stream 54. The first mobilized viscous hydrocarbon stream may flow to second hydrocarbon well 32 and be produced from the subterranean formation. Injection of the first thermal recovery stream and production of the first mobilized viscous hydrocarbon stream may produce and/or generate first thermal chamber 50 within the subterranean formation, as illustrated in FIG. 3. The first thermal chamber may grow with time, as illustrated in FIG. 4, eventually reaching and/or contacting second hydrocarbon well 32.

In the example of the flooding processes, corresponding pairs of the spaced-apart hydrocarbon wells may be utilized to produce mobilized viscous hydrocarbons from the subterranean formation. This utilization of the corresponding pairs of spaced-apart hydrocarbon wells may include injection of corresponding thermal recovery streams into corresponding injection wells and production of corresponding mobilized viscous hydrocarbon streams from corresponding production wells. This utilization thus may produce and/or generate corresponding thermal chambers within the subterranean formation. These thermal chambers may grow with time, eventually merging, forming corresponding communicating chambers, and/or defining corresponding interface regions therebetween. As an example, and in addition to formation of first thermal chamber 50, system 10 may include a second injection well and a second production well that together may be utilized to form, define, and/or generate another thermal chamber within the subterranean formation. The first thermal chamber and the other thermal chamber may grow with time, eventually merging, forming the communicating chamber, and/or defining the interface region therebetween.

Regardless of the exact mechanism utilized to form, produce, and/or generate communicating thermal chamber 80, formation of the communicating chamber may heat subterranean formation 44, communicating thermal chamber 80, first thermal chamber 50, and/or second thermal chamber 60 to a chamber temperature that is above a naturally occurring temperature within the subterranean formation. As discussed, maintaining the chamber temperature may be costly, thereby limiting an economic viability of thermal recovery processes. However, formation of such a heated and communicating thermal chamber may permit methods 200 to be utilized to improve an efficiency of production of viscous hydrocarbons from the subterranean formation.

With this in mind, FIG. 5 is a flowchart depicting methods 200, according to the present disclosure, for recovering viscous hydrocarbons from a subterranean formation. Methods 200 may include performing a thermal recovery process at 205 and/or transitioning at 210. Methods 200 include injecting a solvent flood vapor stream at 215 and may include generating solvent flood-mobilized viscous hydrocarbons at 220, heating the solvent flood vapor stream at 225, and/or cooling a thermal chamber at 230. Methods 200 also may include ceasing injection of the solvent flood vapor stream at 235 and/or injecting a gas flood stream at 240. Methods 200 also include producing solvent flood-mobilized viscous hydrocarbons at 245 and may include reversing injection and production at 250.

Performing the thermal recovery process at 205 may include performing any suitable thermal recovery process within the subterranean formation. This may include performing a first thermal recovery process to form, produce, and/or generate a first thermal chamber within the subterranean formation. This also may include performing a second thermal recovery process to form, produce, and/or generate a second thermal chamber within the subterranean formation. The first thermal recovery process may include injection of a first thermal recovery stream into the first thermal chamber and production of a first mobilized viscous hydrocarbon stream from the subterranean formation and/or from the first thermal chamber. Similarly, the second thermal recovery process may include injection of a second thermal recovery stream into the second thermal chamber and production of a second mobilized viscous hydrocarbon stream from the subterranean formation and/or from the second thermal chamber.

When methods 200 include the performing at 205, methods 200 may include continuing the performing at 205 until the first thermal chamber and the second thermal chamber define an interface region therebetween. The interface region may include a region of overlap between the first thermal chamber and the second thermal chamber and/or may permit fluid communication, within the subterranean formation, between the first thermal chamber and the second thermal chamber. The establishment of the interface region and/or the fluid communication between the thermal chambers may be detected and/or confirmed by means of any suitable reservoir surveillance method. Examples of such reservoir surveillance methods include, but are not limited to, 2D and/or 3D seismic surveillance methods, pressure data analysis, temperature data analysis, and/or injection and production data analysis.

Examples of the first thermal recovery process and/or of the second thermal recovery process include a cyclic steam stimulation process, a solvent-assisted cyclic steam stimulation process, a steam flooding process, a solvent-assisted steam flooding process, a steam-assisted gravity drainage process, a solvent-assisted steam-assisted gravity drainage process, a heated vapor extraction process, a liquid addition to steam to enhance recovery process, and/or a near-azeotropic gravity drainage process. Additional examples of the first thermal recovery process and/or of the second thermal recovery process include a steam injection process, a solvent injection process, and/or a solvent-steam mixture injection process.

It is within the scope of the present disclosure that methods 200 are not required to include the performing at 205. Instead, methods 200 may be performed with, via, and/or utilizing a hydrocarbon production system that already includes the first thermal chamber, the second thermal chamber, and the interface region therebetween. As an example, the first thermal recovery process and the second thermal recovery process may be performed and the first thermal chamber and the second thermal chamber may be formed, within the subterranean formation, prior to initiation of methods 200.

It is within the scope of the present disclosure that the interface region may include and/or be a region of overlap between two adjacent thermal chambers, such as interface region 70 that is illustrated in FIG. 4.

When methods 200 include the performing at 205, methods 200 also may include the transitioning at 210. The transitioning at 210 may include transitioning from performing the first thermal recovery process in the first thermal chamber and performing the second thermal recovery process in the second thermal chamber to performing the injecting at 215 and the producing at 245. The transitioning at 210, when performed, may be initiated based upon and/or responsive to any suitable transition criteria.

Examples of the transition criteria include establishing and/or detecting fluid communication between the first thermal chamber and the second thermal chamber. Another example of the transition criteria includes production, from the subterranean formation, of at least a threshold fraction of an original oil in place. Examples of the threshold fraction include at least 10%, at least 20%, at least 30%, at least 40%, at least 50%, at least 60%, at least 70%, and/or at least 80% of the original oil in place.

Injecting the solvent flood vapor stream at 215 may include injecting the solvent flood vapor stream into the first thermal chamber via a solvent flood injection well. The solvent flood vapor stream also may be referred to herein as an injected solvent flood vapor stream. The solvent flood injection well may extend within the first thermal chamber, and the injecting at 215 may include injecting to produce and/or generate solvent flood-mobilized viscous hydrocarbons within the subterranean formation and/or within the first thermal chamber.

The solvent flood injection well may include a hydrocarbon well utilized to form the first thermal chamber. In another embodiment, the solvent flood injection well may be drilled from the surface to intersect the existing first thermal chamber. In another embodiment, the solvent flood injection well is within the first thermal chamber but it may be drilled from the surface before the existence of the first thermal chamber. Injection of the solvent flood vapor stream is illustrated schematically in FIG. 4, with solvent flood vapor stream 82 being injected into first thermal chamber 50 from and/or via first hydrocarbon well 31 and/or third hydrocarbon well 33, depending upon the configuration of hydrocarbon production system 10.

The solvent flood vapor stream has a solvent flood vapor stream dew point temperature that is less than a first thermal recovery stream dew point temperature of the first thermal recovery stream and also less than a second thermal recovery stream dew point temperature of the second thermal recovery stream. As such, injection of the solvent flood vapor stream may permit recovery of stored thermal energy from the subterranean formation, from the first thermal chamber, and/or from the second thermal chamber.

Stated another way, and since the solvent flood vapor stream dew point temperature is less than the first thermal recovery stream dew point temperature and also less than the second thermal recovery stream dew point temperature, a temperature of the subterranean formation, such as of the first thermal chamber and/or of the second thermal chamber, may be greater than the solvent flood vapor stream dew point temperature at the pressure of the subterranean formation before commencing the injecting at 215. Thus, the solvent flood vapor stream may be injected at an injection temperature that is less than the temperature of the subterranean formation, thereby permitting the solvent flood vapor stream to absorb the stored thermal energy from the subterranean formation.

The temperature of the injected solvent flood vapor stream may increase by absorbing the stored thermal energy from the subterranean formation. The injected solvent flood vapor stream with increased temperature may flow through the subterranean formation and/or the communicating thermal chambers within to reach parts of the subterranean formation with temperatures lower than the dew point temperature of the solvent flood vapor stream at the operating pressure. The injected solvent flood vapor stream with increased temperature may heat the parts of the subterranean formation with temperatures lower than the dew point temperature of the solvent flood vapor stream by contact and/or by condensation. The injected solvent flood vapor stream may mobilize the viscous hydrocarbons in the parts of the subterranean formation with temperatures lower than the dew point temperature of the solvent flood vapor stream by heating, diluting, and/or dissolving the viscous hydrocarbons.

It is within the scope of the present disclosure that the solvent flood vapor stream dew point temperature may differ from, or be less than, the first thermal recovery stream dew point temperature and the second thermal recovery stream dew point temperature by any suitable value and/or magnitude. As examples, and at a pressure of 101.325 kilopascals, the solvent flood vapor stream dew point temperature may differ from, be less than, or be less than a minimum of the first thermal recovery stream dew point temperature and the second thermal recovery stream dew point temperature by at least 10° C., at least 30° C., at least 50° C., at least 70° C., at least 90° C., at least 110° C., at least 130° C., at least 150° C., at least 170° C., at least 190° C., and/or at least 210° C.

The injecting at 215 may include injecting with, via, and/or utilizing any suitable solvent flood injection well and/or with, via, and/or utilizing any suitable portion and/or region of the solvent flood injection well. As an example, the solvent flood injection well may include an at least substantially horizontal and/or deviated injection well region that extends within the first thermal chamber. Under these conditions, the injecting at 215 may include injecting the solvent flood vapor stream from the at least substantially horizontal and/or deviated injection well region. As another example, the solvent flood injection well may include an at least substantially vertical injection well region that extends within the first thermal chamber. Under these conditions, the injecting at 215 may include injecting the solvent flood vapor stream from the at least substantially vertical injection well region.

The solvent flood vapor stream may include any suitable composition. As an example, the solvent flood vapor stream may include at least a threshold weight percentage of hydrocarbon molecules with a specified number of carbon atoms. Examples of the threshold weight percentage include at least 20 weight percent, at least 30 weight percent, at least 40 weight percent, at least 50 weight percent, at least 60 weight percent, at least 70 weight percent, and/or at least 80 weight percent. Examples of the specified number of carbon atoms include at least 2, at least 3, at least 4, at least 5, at most 9, at most 8, at most 7, at most 6, at most 5, and/or at most 4 carbon atoms. As additional examples, the solvent flood vapor stream may include one or more of a hydrocarbon, an alkane, an alkene, an alkyne, an aliphatic compound, a naphthenic compound, an aromatic compound, an olefinic compound, natural gas condensate, liquefied petroleum gas, a naphtha product, a crude oil refinery stream, a mixture of a hydrocarbon solvent and steam in any suitable relative proportions, and/or a near-azeotropic mixture of the hydrocarbon solvent and steam.

Figure 6:
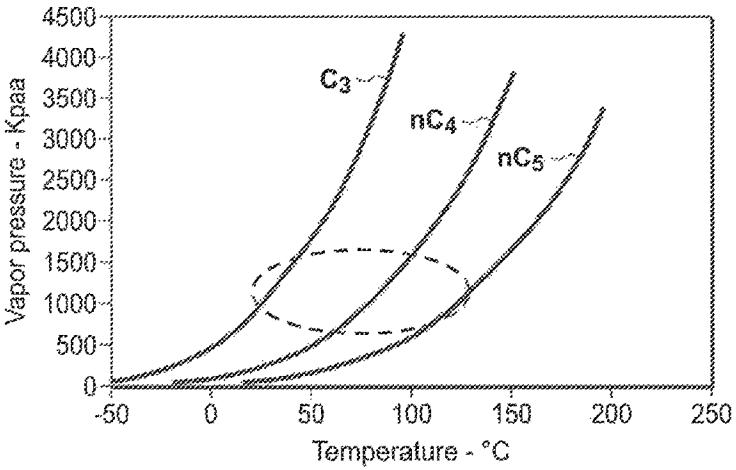
FIG. 6 is a plot illustrating vapor pressure as a function of temperature for three solvent flood vapor streams that may be utilized with methods according to the present disclosure.

FIG. 6 illustrates vapor pressure as a function of temperature for three normal hydrocarbons that may be utilized as solvent flood vapor streams according to the present disclosure. The circled region indicates vapor pressure-temperature combinations that may be experienced, within the subterranean formation, while performing methods 200; and a particular solvent flood vapor stream, or combination of solvent flood vapor streams may be selected based upon temperatures and pressures that are present within the subterranean formation. FIG. 6 illustrates normal alkane hydrocarbons; however, it is within the scope of the present disclosure that any suitable hydrocarbon may be utilized, including those that are discussed herein.

The solvent flood vapor stream may be injected at any suitable injection temperature. The injection temperature may be equal to the dew point temperature of the solvent flood vapor stream for a target operating pressure within the subterranean formation and/or for a target injection pressure of the solvent flood vapor stream. The solvent flood vapor stream may be injected with some degrees of superheat relative to the dew point temperature of the solvent flood vapor stream at the operating pressure and/or at the injection pressure. Examples of the degrees of superheat include at least 1° C., at least 5° C., at least 10° C., at least 20° C., at least 30° C., or at least 40° C. The solvent flood vapor stream may be injected at any suitable injection pressure. As an example, the injection pressure may be equal to or greater than the subterranean formation pressure before commencing the injecting at 215.

The solvent flood vapor stream may be received as vapor or liquid at a wellhead of the solvent flood injection well for injection. The liquid may be vaporized at the wellhead utilizing a vaporization facility to prepare the solvent flood vapor stream for injection. The vaporization facility may be specific to each wellhead of a group of spaced-apart wellheads or may be a centralized vaporization facility that provides the solvent flood vapor stream to a group of spaced-apart wellheads. The vaporization facility may be a part of a central processing facility.

The solvent flood vapor stream may be injected as an unheated solvent flood vapor stream. As an example, the unheated solvent flood vapor stream may include a vapor stream at ambient temperature, or a vaporized liquid stream at ambient temperature, prepared by flashing a liquid stream to vapor from higher pressure to a lower pressure.

The solvent flood vapor stream may be injected as a heated solvent flood vapor stream. As an example, the heated solvent flood vapor stream may include a vapor stream at a temperature higher than ambient temperature, or a vaporized liquid stream at a temperature higher than ambient temperature, that is prepared by evaporating a liquid stream to vapor by providing heat and/or increasing temperature.

The injecting at 215 may include injecting to produce, to facilitate, and/or to maintain the target operating pressure within the subterranean formation. In addition, and when the solvent flood vapor stream includes the near-azeotropic mixture of the hydrocarbon solvent and steam, a hydrocarbon solvent molar fraction of the hydrocarbon solvent within the solvent flood vapor stream may be within a threshold molar fraction range of an azeotropic hydrocarbon solvent molar fraction of the solvent flood vapor stream at the target operating pressure. Examples of the threshold molar fraction range include at least 50%, at least 60%, at least 70%, at least 80%, at least 90%, at least 95%, at most 100%, at most 95%, at most 90%, at most 85%, and/or at most 80% of the azeotropic hydrocarbon solvent molar fraction of the solvent flood vapor stream at the target operating pressure.

The injecting at 215 additionally or alternatively may include injecting to produce, facilitate, and/or maintain a pressure differential between the solvent flood injection well and a solvent flood production well. This pressure differential, which may include a greater pressure proximal the solvent flood injection well when compared to the solvent flood production well, may facilitate the producing at 245 and/or may provide a motive force for flow of the solvent flood-mobilized viscous hydrocarbons from the subterranean formation during the producing at 245.

It is within the scope of the present disclosure that methods 200 may be performed with, via, and/or utilizing any suitable number of solvent flood injection wells. As an example, the solvent flood injection well may be a first solvent flood injection well of a plurality of spaced-apart solvent flood injection wells. Each of the plurality of solvent flood injection wells may extend within a corresponding thermal chamber that extends within the subterranean formation. Under these conditions, the injecting at 215 may include injecting the solvent flood vapor stream into the subterranean formation via each of the plurality of spaced-apart solvent flood injection wells. Stated another way, the injecting at 215 may include injecting the solvent flood vapor stream into each corresponding thermal chamber that is associated with each of the plurality of spaced-apart solvent flood injection wells.

Generating solvent flood-mobilized viscous hydrocarbons at 220 may include generating the solvent flood-mobilized viscous hydrocarbons responsive to and/or as a result of the injecting at 215. The generating at 220 may include generating the solvent flood-mobilized viscous hydrocarbons within the subterranean formation and/or in any suitable manner. As an example, the generating at 220 may include heating the viscous hydrocarbons with the solvent flood vapor stream to generate the solvent flood-mobilized viscous hydrocarbons. As another example, the generating at 220 may include diluting the viscous hydrocarbons with condensed portions of the solvent flood vapor stream to generate the solvent flood-mobilized viscous hydrocarbons. As yet another example, the generating at 220 may include dissolving the viscous hydrocarbons in and/or within the condensed portions of the solvent flood vapor stream to generate the solvent flood-mobilized viscous hydrocarbons.

Heating the solvent flood vapor stream at 225 may include heating the solvent flood vapor stream with, within, and/or via thermal contact with the subterranean formation, the first thermal chamber, and/or the second thermal chamber. As an example, and as discussed, the first thermal chamber and/or the second thermal chamber may have and/or define respective chamber temperatures that are greater than a solvent flood vapor stream injection temperature of the solvent flood vapor stream. As such, injection of the solvent flood vapor stream into the subterranean formation causes, produces and/or generates heating of the solvent flood vapor stream to an increased temperature.

Cooling the thermal chamber at 230 may include cooling the first thermal chamber and/or cooling the second thermal chamber via contact between the first thermal chamber and/or the second thermal chamber and the solvent flood vapor stream. As discussed, the solvent flood vapor stream injection temperature may be less than the chamber temperature of the first thermal chamber and/or of the second thermal chamber. As such, injection of the solvent flood vapor stream into the subterranean formation causes, produces and/or generates cooling of the first thermal chamber and/or of the second thermal chamber.

Ceasing injection of the solvent flood vapor stream at 235 may include ceasing the injecting at 215. This may include ceasing the injecting at 215 subsequent to performing the producing at 245 for at least a threshold production time period and/or prior to performing and/or initiating the injecting at 240.

Injecting the gas flood stream at 240 may include injecting the gas flood stream into the subterranean formation, or initiating injection of the gas flood stream into the subterranean formation, subsequent to performing the injecting at 215, subsequent to performing the injecting at 215 for at least a threshold injection time period, and/or subsequent to production of a target fraction of an original oil in place from the subterranean formation. The injecting at 240 may, but is not required to, include injecting the gas flood stream into the subterranean formation with, via, and/or utilizing the solvent flood injection well. Additionally or alternatively, the injecting at 240 may include injecting to permit, facilitate, and/or provide a motive force for production of the solvent flood mobilized viscous hydrocarbons, for production of the solvent flood vapor stream from the subterranean formation, and/or to produce and/or recover at least a fraction of the solvent flood vapor stream from the subterranean formation, such as during the producing at 245. The solvent flood vapor stream and/or at least a fraction of the solvent flood vapor stream may be produced and/or recovered from the subterranean formation in vapor and/or liquid phase.

The gas flood stream may include any suitable gas, gaseous, and/or non-condensable fluid stream. As examples, the gas flood stream may include one or more of natural gas, carbon dioxide, nitrogen, a flue gas, methane, ethane, and/or propane.

Producing solvent flood-mobilized viscous hydrocarbons at 245 may include producing the solvent flood-mobilized viscous hydrocarbons from a second thermal chamber that extends within the subterranean formation and/or via a solvent flood production well that extends within the second thermal chamber. The producing at 245 is concurrent, or at least partially concurrent, with the injecting at 215. Stated another way, the injecting at 215 and the producing at 245 have and/or exhibit at least a threshold amount of temporal overlap.

The solvent flood production well may consist of a hydrocarbon well utilized to form the second thermal chamber. In another embodiment, the solvent flood production well may be drilled from the surface to intersect the existing second thermal chamber. In another embodiment, the solvent flood production well is within the second thermal chamber but it may be drilled from the surface before the existence of the second thermal chamber. Production of the solvent flood-mobilized viscous hydrocarbons is illustrated schematically in FIG. 4, with solvent flood-mobilized viscous hydrocarbons 84 being produced from second thermal chamber 60 via second hydrocarbon well 32 and/or fourth hydrocarbon well 34, depending upon the exact configuration of hydrocarbon production system 10.

It is within the scope of the present disclosure that, in addition to the solvent flood-mobilized viscous hydrocarbons, the producing at 245 also may include producing one or more other fluids from the subterranean formation. As examples, the producing at 245 may include producing at least a fraction of the first thermal recovery stream, at least a fraction of the second thermal recovery stream, water, at least a fraction of the first mobilized viscous hydrocarbon stream, at least a fraction of the second mobilized viscous hydrocarbon stream, and/or at least a fraction of the solvent flood vapor stream in liquid and/or in vapor phases.

The injecting at 215 and the producing at 245 may include sweeping solvent flood-mobilized viscous hydrocarbons from the first thermal chamber and/or into the second thermal chamber. Stated another way, the producing at 245 may include flowing a fraction of the solvent flood-mobilized viscous hydrocarbons from the first thermal chamber and into the second thermal chamber prior to production of the solvent flood-mobilized viscous hydrocarbons.

As discussed herein, hydrocarbon production systems that may be utilized to perform methods 200 may include any suitable number of hydrocarbon wells, and any suitable subset of these hydrocarbon wells may be utilized as solvent flood injection wells and/or as solvent flood production wells during methods 200. As such, it is within the scope of the present disclosure that one or more intermediate thermal chambers may extend between the first thermal chamber and the second thermal chamber. These one or more intermediate thermal chambers may function as the interface region between the first thermal chamber and the second thermal chamber and/or may provide the fluid communication between the first thermal chamber and the second thermal chamber. Under these conditions, the producing at 245 further may include sweeping and/or flowing at least a subset of the solvent flood-mobilized viscous hydrocarbons through the one or more intermediate thermal chambers as the subset of the solvent flood-mobilized viscous hydrocarbons flows toward and/or into the solvent flood production well.

It also is within the scope of the present disclosure that methods 200 may be performed with, via, and/or utilizing any suitable number of solvent flood production wells. As an example, the solvent flood production well may be a first solvent flood production well of a plurality of spaced-apart solvent flood production wells. Each of the plurality of solvent flood production wells may extend within a corresponding thermal chamber that extends within the subterranean formation. Under these conditions, the producing at 245 may include producing the solvent flood-mobilized viscous hydrocarbons from the subterranean formation via each of the plurality of spaced-apart solvent flood production wells. Stated another way, the producing at 245 may include producing the solvent flood-mobilized viscous hydrocarbons from each corresponding thermal chamber that is associated with each of the plurality of spaced-apart solvent flood production wells.

The producing at 245 may include producing with, via, and/or utilizing any suitable solvent flood production well and/or with, via, and/or utilizing any suitable portion and/or region of the solvent flood production well. As an example, the solvent flood production well may include an at least substantially horizontal and/or deviated production well region that extends within the second thermal chamber. Under these conditions, the producing at 245 may include producing the solvent flood-mobilized viscous hydrocarbons with, via, and/or utilizing the at least substantially horizontal and/or deviated production well region. As another example, the solvent flood production well may include an at least substantially vertical production well region that extends within the second thermal chamber. Under these conditions, the producing at 245 may include producing the solvent flood-mobilized viscous hydrocarbons with, via, and/or utilizing the at least substantially horizontal production well region.

Reversing injection and production at 250 may be performed and/or initiated subsequent to performing the injecting at 215, subsequent to performing the injecting at 215 for at least the threshold injection time period, subsequent to performing the producing at 245, and/or subsequent to performing the producing at 245 for at least the threshold production time period. The reversing at 250 may include reversing the injecting at 215 and the producing at 245 in any suitable manner. As an example, the reversing at 250 may include reversing the injecting at 215 by injecting the solvent flood vapor stream into the second thermal chamber via a hydrocarbon well that extends within the second thermal chamber, such as the solvent flood production well. As another example, the reversing at 250 may include reversing the producing at 245 by producing the solvent flood-mobilized viscous hydrocarbons from the first thermal chamber via a hydrocarbon well that extends within the first thermal chamber, such as the solvent flood injection well.

Figure 7:
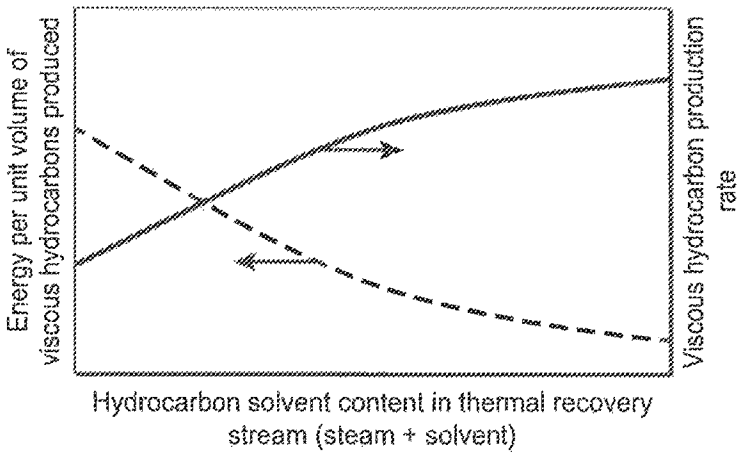
FIG. 7 is a plot illustrating energy consumption and oil production rate for methods according to the present disclosure.

FIG. 7 is a plot illustrating energy consumption and oil production rate as a function of hydrocarbon solvent content in the solvent flood vapor stream for methods 200 according to the present disclosure. Transitioning from a thermal recovery process utilizing only steam as the thermal recovery process stream, such as may be performed during the performing at 205, to injection of the solvent flood vapor stream, such as during the injecting at 215, and production of the solvent flood-mobilized viscous hydrocarbons, such as during the producing at 245, may result in a significant decrease in energy consumption. This decrease in energy consumption, which is illustrated as energy consumption per unit volume of viscous hydrocarbons produced from the subterranean formation, is illustrated by the dashed line in FIG. 7.

In addition, transitioning from the thermal recovery process utilizing only steam as the thermal recovery stream to injection of the solvent flood vapor stream and production of the solvent flood-mobilized viscous hydrocarbons may result in an increase in a viscous hydrocarbon production rate from the subterranean formation. This increase in viscous hydrocarbon production rate is illustrated in solid lines in FIG. 7.

Both the decrease in energy consumption and the increase in viscous hydrocarbon production rate may improve the overall economics of methods 200 when compared to other thermal recovery processes without the enhancement of the solvent flood vapor stream follow-up. Thus, methods 200 may permit economic production of additional viscous hydrocarbons from the subterranean formation and/or may provide a longer economic service life for a given hydrocarbon production system.

Figure 8:
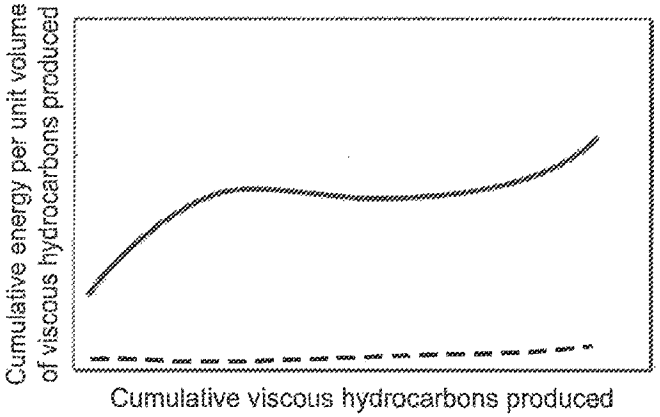
FIG. 8 is a plot illustrating energy consumption as a function of cumulative oil production and comparing methods, according to the present disclosure, with a steam flood process.

FIG. 8 is a plot illustrating energy consumption as a function of cumulative oil production and comparing methods according to the present disclosure, as illustrated by the dashed line, with a steam flood process, as illustrated by the solid line. In contrast with methods 200, which are disclosed herein and inject a solvent flood vapor stream into the subterranean formation, the steam flood process injects steam into the subterranean formation. As illustrated, the steam flood process utilizes considerably more energy per unit volume of viscous hydrocarbons produced. Once again, methods 200, which are disclosed herein, provide a significant energy savings, and therefore significant economic benefits, over other thermal recovery processes.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It also is within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

EMBODIMENTS

Additional embodiments of the invention herein are as follows:

Embodiment 1

A method for recovering viscous hydrocarbons from a subterranean formation, the method comprising:

injecting a solvent flood vapor stream into a first thermal chamber that extends within the subterranean formation via a solvent flood injection well that extends within the first thermal chamber to generate solvent flood-mobilized viscous hydrocarbons within the subterranean formation; and at least partially concurrently with the injecting the solvent flood vapor stream, producing the solvent flood-mobilized viscous hydrocarbons from a second thermal chamber that extends within the subterranean formation via a solvent flood production well that extends within the second thermal chamber, wherein:

(i) the first thermal chamber was formed via a first thermal recovery process that injected a first thermal recovery stream into the first thermal chamber and produced a first mobilized viscous hydrocarbon stream from the subterranean formation;

(ii) the second thermal chamber was formed via a second thermal recovery process that injected a second thermal recovery stream into the second thermal chamber and produced a second mobilized viscous hydrocarbon stream from the subterranean formation;

(iii) the first thermal chamber and the second thermal chamber define an interface region therebetween, wherein the interface region permits fluid communication between the first thermal chamber and the second thermal chamber; and (iv) a solvent flood vapor stream dew point temperature of the solvent flood vapor stream is less than a first thermal recovery stream dew point temperature of the first thermal recovery stream and also is less than a second thermal recovery stream dew point temperature of the second thermal recovery stream.

Embodiment 2

The method of embodiment 1, wherein the solvent flood injection well includes at least one of:

(i) an at least substantially horizontal injection well region, which extends within the first thermal chamber, wherein the injecting the solvent flood vapor stream includes injecting from the at least substantially horizontal injection well region; and (ii) an at least substantially vertical injection well region, which extends within the first thermal chamber, wherein the injecting the solvent flood vapor stream includes injecting from the at least substantially vertical injection well region.

Embodiment 3

The method of any one of embodiments 1-2, wherein the injecting the solvent flood vapor stream includes generating the solvent flood-mobilized viscous hydrocarbons within the subterranean formation.

Embodiment 4

The method of embodiment 3, wherein the generating includes at least one of:

(i) heating the viscous hydrocarbons with the solvent flood vapor stream to generate the solvent flood-mobilized viscous hydrocarbons;

(ii) diluting the viscous hydrocarbons with a condensed portion of the solvent flood vapor stream to generate the solvent flood-mobilized viscous hydrocarbons; and (iii) dissolving the viscous hydrocarbons in the condensed portion of the solvent flood vapor stream to generate the solvent flood-mobilized viscous hydrocarbons.

Embodiment 5

The method of any one of embodiments 1-4, wherein the solvent flood vapor stream includes a plurality of solvent flood hydrocarbon molecules, and is comprised of at least 50 weight percent of hydrocarbons with 2-6 carbon atoms.

Embodiment 6

The method of any one of embodiments 1-5, wherein the solvent flood vapor stream includes at least one of:

(i) a hydrocarbon;
(ii) an alkane;
(iii) an alkene;
(iv) an alkyne;
(v) an aliphatic compound;
(vi) a naphthenic compound;
(vii) an aromatic compound;
(viii) an olefinic compound;
(ix) natural gas condensate;
(x) liquefied petroleum gas;
(xi) a naphtha product; and
(xii) a crude oil refinery stream.

Embodiment 7

The method of any one of embodiments 1-6, wherein a difference between the solvent flood vapor stream dew point temperature and a minimum of the first thermal recovery stream dew point temperature and the second thermal recovery stream dew point temperature is at least one of:

(i) at least 10° C. at 101.325 kilopascals;
(ii) at least 30° C. at 101.325 kilopascals;
(iii) at least 50° C. at 101.325 kilopascals;
(iv) at least 70° C. at 101.325 kilopascals;
(v) at least 90° C. at 101.325 kilopascals;
(vi) at least 110° C. at 101.325 kilopascals;
(vii) at least 130° C. at 101.325 kilopascals;
(viii) at least 150° C. at 101.325 kilopascals;
(ix) at least 170° C. at 101.325 kilopascals;
(x) at least 190° C. at 101.325 kilopascals; and
(xi) at least 210° C. at 101.325 kilopascals.

Embodiment 8

The method of any one of embodiments 1-7, wherein the injecting the solvent flood vapor stream includes at least one of:

(i) injecting an unheated solvent flood vapor stream;

(ii) injecting a heated solvent flood vapor stream;

(iii) injecting the solvent flood vapor stream at the solvent flood vapor stream dew point temperature for a target operating pressure within the subterranean formation; and (iv) injecting the solvent flood vapor stream with some degrees of superheat relative to the solvent flood vapor stream dew point temperature for the target operating pressure within the subterranean formation.

Embodiment 9

The method of any one of embodiments 1-8, wherein the solvent flood vapor stream includes a mixture of a hydrocarbon solvent and steam.

Embodiment 10

The method of any one of embodiments 1-9, wherein the solvent flood vapor stream includes a near-azeotropic mixture of hydrocarbon solvent and steam.

Embodiment 11

The method of any one of embodiments 1-10, wherein a hydrocarbon solvent molar fraction in the solvent flood vapor stream is 70-100% of an azeotropic hydrocarbon solvent molar fraction of the solvent flood vapor stream at a target operating pressure within the subterranean formation.

Embodiment 12

The method of any one of embodiments 1-11, wherein the solvent flood injection well is a first solvent flood injection well of a plurality of spaced-apart solvent flood injection wells, wherein each solvent flood injection well of the plurality of spaced-apart solvent flood injection wells extends within a corresponding thermal chamber that extends within the subterranean formation, and further wherein the injecting the solvent flood vapor stream includes injecting the solvent flood vapor stream into the subterranean formation via each solvent flood injection well of the plurality of spaced-apart solvent flood injection wells.

Embodiment 13

The method of any one of embodiments 1-12, wherein, during the injecting the solvent flood vapor stream, the first thermal chamber and the second thermal chamber define respective chamber temperatures that are greater than a solvent flood vapor stream injection temperature of the solvent flood vapor stream.

Embodiment 14

The method of any one of embodiments 1-13, wherein the method further includes heating the solvent flood vapor stream via thermal contact between the solvent flood vapor stream and at least one of the first thermal chamber and the second thermal chamber.

Embodiment 15

The method of any one of embodiments 1-14, wherein the method further includes cooling at least one of the first thermal chamber and the second thermal chamber via thermal contact with the solvent flood vapor stream.

Embodiment 16

The method of any one of embodiments 1-15, wherein the producing the solvent flood-mobilized viscous hydrocarbons further includes producing, via the solvent flood production well, at least one of:

(i) at least a fraction of the first thermal recovery stream;

(ii) at least a fraction of the second thermal recovery stream;

(iii) water; and (iv) at least a fraction of the solvent flood vapor stream.

Embodiment 17

The method of any one of embodiments 1-16, wherein the producing the solvent flood-mobilized viscous hydrocarbons includes flowing a fraction of the solvent flood-mobilized viscous hydrocarbons into the second thermal chamber from the first thermal chamber.

Embodiment 18

The method of any one of embodiments 1-17, wherein, at least partially concurrently with the injecting the solvent flood vapor stream, the method further includes producing at least a fraction of at least one of the first mobilized viscous hydrocarbon stream and the second mobilized viscous hydrocarbon stream.

Embodiment 19

The method of any one of embodiments 1-18, wherein the solvent flood production well is a first solvent flood production well of a plurality of spaced-apart solvent flood production wells, wherein each solvent flood production well of the plurality of spaced-apart solvent flood production wells extends within a corresponding thermal chamber that extends within the subterranean formation, and further wherein the producing the solvent flood-mobilized viscous hydrocarbons includes producing the solvent flood-mobilized viscous hydrocarbons via each solvent flood production well of the plurality of spaced-apart solvent flood production wells.

Embodiment 20

The method of any one of embodiments 1-19, wherein the solvent flood production well includes at least one of:

(i) an at least substantially horizontal production well region, which extends within the second thermal chamber, wherein the producing the solvent flood-mobilized viscous hydrocarbons includes producing via the at least substantially horizontal production well region; and (ii) an at least substantially vertical production well region, which extends within the second thermal chamber, wherein the producing the solvent flood-mobilized viscous hydrocarbons includes producing from the at least substantially vertical production well region.

Embodiment 21

The method of any one of embodiments 1-20, wherein the method further includes performing at least a portion of at least one of the first thermal recovery process and the second thermal recovery process.

Embodiment 22

The method of embodiment 21, wherein at least one of the first thermal recovery process and the second thermal recovery process includes at least one of:

(i) a cyclic steam stimulation process;

(ii) a solvent-assisted cyclic steam stimulation process;

(iii) a steam flooding process;

(iv) a solvent-assisted steam flooding process;

(v) a steam-assisted gravity drainage process;

(vi) a solvent-assisted steam-assisted gravity drainage process;

(vii) a heated vapor extraction process;

(viii) a liquid addition to steam to enhance recovery process; and (ix) a near-azeotropic gravity drainage process.

Embodiment 23

The method of any one of embodiments 21-22, wherein at least one of the first thermal recovery process and the second thermal recovery process includes at least one of:

(i) a steam injection process;

(ii) a solvent injection process; and (iii) a solvent-steam mixture injection process.

Embodiment 24

The method of any one of embodiments 21-23, wherein the method further includes transitioning from performing at least one of the first thermal recovery process in the first thermal chamber and performing the second thermal recovery process in the second thermal chamber to performing the injecting the solvent flood vapor stream into the first thermal chamber and the producing the solvent flood-mobilized viscous hydrocarbons from the second thermal chamber.

Embodiment 25

The method of embodiment 24, wherein the method includes initiating the transitioning responsive to a transition criteria.

Embodiment 26

The method of embodiment 25, wherein the transition criteria includes at least one of:

(i) establishing fluid communication between the first thermal chamber and the second thermal chamber; and (ii) detecting fluid communication between the first thermal chamber and the second thermal chamber.

Embodiment 27

The method of any one of embodiments 25-26, wherein the transition criteria includes at least one of:

(i) production of at least 10% of original oil in place from the subterranean formation;

(ii) production of at least 20% of original oil in place from the subterranean formation;

(iii) production of at least 30% of original oil in place from the subterranean formation;

(iv) production of at least 40% of original oil in place from the subterranean formation;

(v) production of at least 50% of original oil in place from the subterranean formation;

(vi) production of at least 60% of original oil in place from the subterranean formation;

(vii) production of at least 70% of original oil in place from the subterranean formation; and (viii) production of at least 80% of original oil in place from the subterranean formation.

Embodiment 28

The method of any one of embodiments 1-27, wherein, subsequent to the injecting the solvent flood vapor stream, the method further includes:

(i) injecting a flood gas stream into the subterranean formation via the solvent flood injection well; and (ii) during the injecting the flood gas stream, producing the solvent flood-mobilized viscous hydrocarbons from the solvent flood production well.

Embodiment 29

The method of embodiment 28, wherein the injecting the flood gas stream includes injecting at least one of:

(i) a non-condensable gas;

(ii) natural gas;

(iii) carbon dioxide;

(iv) nitrogen;

(v) a flue gas;

(vi) methane;

(vii) ethane; and (viii) propane.

Embodiment 30

The method of any one of embodiments 28-29, wherein the injecting the flood gas stream facilitates the producing the solvent flood-mobilized viscous hydrocarbons.

Embodiment 31

The method of any one of embodiments 28-30, wherein at least one of:

(i) during the injecting the flood gas stream, the producing the solvent flood-mobilized viscous hydrocarbons includes producing at least a fraction of the solvent flood vapor stream; and (ii) the injecting the flood gas stream includes injecting the flood gas stream to recover at least a fraction of the solvent flood vapor stream from the subterranean formation.

Embodiment 32

The method of any one of embodiments 28-31, wherein the method includes ceasing the injecting the solvent flood vapor stream prior to initiating the injecting the flood gas stream.

Embodiment 33

The method of any one of embodiments 28-32, wherein the method includes initiating the injecting the flood gas stream subsequent to producing a target fraction of original oil in place from the subterranean formation.

Embodiment 34

The method of any one of embodiments 1-33, wherein, subsequent to performing the injecting the solvent flood vapor stream and the producing the solvent flood-mobilized viscous hydrocarbons, the method further includes reversing the injecting and reversing the producing, wherein:

(i) the reversing the injecting includes injecting the solvent flood vapor stream into the second thermal chamber; and (ii) the reversing the producing includes producing the solvent flood-mobilized viscous hydrocarbons from the first thermal chamber.

Embodiment 35

The method of any one of embodiments 1-34, wherein the injecting the solvent flood vapor stream includes maintaining a pressure differential between the solvent flood injection well and the solvent flood production well to facilitate the producing the solvent flood-mobilized viscous hydrocarbons.

INDUSTRIAL APPLICABILITY

The methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method for recovering viscous hydrocarbons from a subterranean formation, the method comprising:

injecting a solvent flood vapor stream into a first thermal chamber that extends within the subterranean formation via a solvent flood injection well that extends within the first thermal chamber to generate solvent flood-mobilized viscous hydrocarbons within the subterranean formation; and at least partially concurrently with the injecting the solvent flood vapor stream, producing the solvent flood-mobilized viscous hydrocarbons from a second thermal chamber that extends within the subterranean formation via a solvent flood production well that extends within the second thermal chamber, wherein:

(i) the first thermal chamber was formed via a first thermal recovery process that injected a first thermal recovery stream into the first thermal chamber and produced a first mobilized viscous hydrocarbon stream from the subterranean formation;

(ii) the second thermal chamber was formed via a second thermal recovery process that injected a second thermal recovery stream into the second thermal chamber and produced a second mobilized viscous hydrocarbon stream from the subterranean formation;

(iii) the first thermal chamber and the second thermal chamber define an interface region therebetween, wherein the interface region permits fluid communication between the first thermal chamber and the second thermal chamber; and (iv) a solvent flood vapor stream dew point temperature of the solvent flood vapor stream is less than a first thermal recovery stream dew point temperature of the first thermal recovery stream and also is less than a second thermal recovery stream dew point temperature of the second thermal recovery stream.

2. The method of claim 1, wherein the solvent flood injection well includes at least one of:

(i) an at least substantially horizontal injection well region, which extends within the first thermal chamber, wherein the injecting the solvent flood vapor stream includes injecting from the at least substantially horizontal injection well region; and (ii) an at least substantially vertical injection well region, which extends within the first thermal chamber, wherein the injecting the solvent flood vapor stream includes injecting from the at least substantially vertical injection well region.

3. The method of claim 2, wherein the injecting the solvent flood vapor stream includes generating the solvent flood-mobilized viscous hydrocarbons within the subterranean formation.

4. The method of claim 3, wherein the generating includes at least one of:

(i) heating the viscous hydrocarbons with the solvent flood vapor stream to generate the solvent flood-mobilized viscous hydrocarbons;

(ii) diluting the viscous hydrocarbons with a condensed portion of the solvent flood vapor stream to generate the solvent flood-mobilized viscous hydrocarbons; and (iii) dissolving the viscous hydrocarbons in the condensed portion of the solvent flood vapor stream to generate the solvent flood-mobilized viscous hydrocarbons.

5. The method of claim 4, wherein the solvent flood vapor stream includes a plurality of solvent flood hydrocarbon molecules, and is comprised of at least 50 weight percent of hydrocarbons with 2-6 carbon atoms.

6. The method of claim 4, wherein the solvent flood vapor stream includes a near-azeotropic mixture of hydrocarbon solvent and steam.

7. The method of claim 4, wherein a hydrocarbon solvent molar fraction in the solvent flood vapor stream is 70-100% of an azeotropic hydrocarbon solvent molar fraction of the solvent flood vapor stream at a target operating pressure within the subterranean formation.

8. The method of claim 4, wherein the solvent flood injection well is a first solvent flood injection well of a plurality of spaced-apart solvent flood injection wells, wherein each solvent flood injection well of the plurality of spaced-apart solvent flood injection wells extends within a corresponding thermal chamber that extends within the subterranean formation, and further wherein the injecting the solvent flood vapor stream includes injecting the solvent flood vapor stream into the subterranean formation via each solvent flood injection well of the plurality of spaced-apart solvent flood injection wells.

9. The method of claim 4, wherein, during the injecting the solvent flood vapor stream, the first thermal chamber and the second thermal chamber define respective chamber temperatures that are greater than a solvent flood vapor stream injection temperature of the solvent flood vapor stream.

10. The method of claim 4, wherein the method further includes heating the solvent flood vapor stream via thermal contact between the solvent flood vapor stream and at least one of the first thermal chamber and the second thermal chamber.

11. The method of claim 4, wherein the method further includes cooling at least one of the first thermal chamber and the second thermal chamber via thermal contact with the solvent flood vapor stream.

12. The method of claim 4, wherein the producing the solvent flood-mobilized viscous hydrocarbons further includes producing, via the solvent flood production well, at least one of:

(i) at least a fraction of the first thermal recovery stream;
(ii) at least a fraction of the second thermal recovery stream;
(iii) water; and
(iv) at least a fraction of the solvent flood vapor stream.

13. The method of claim 12, wherein the producing the solvent flood-mobilized viscous hydrocarbons includes flowing a fraction of the solvent flood-mobilized viscous hydrocarbons into the second thermal chamber from the first thermal chamber.

14. The method of claim 12, wherein the solvent flood production well is a first solvent flood production well of a plurality of spaced-apart solvent flood production wells, wherein each solvent flood production well of the plurality of spaced-apart solvent flood production wells extends within a corresponding thermal chamber that extends within the subterranean formation, and further wherein the producing the solvent flood-mobilized viscous hydrocarbons includes producing the solvent flood-mobilized viscous hydrocarbons via each solvent flood production well of the plurality of spaced-apart solvent flood production wells.

15. The method of claim 4, wherein the method further includes performing at least a portion of at least one of the first thermal recovery process and the second thermal recovery process, wherein at least one of the first thermal recovery process and the second thermal recovery process includes at least one of:

(i) a cyclic steam stimulation process;
(ii) a solvent-assisted cyclic steam stimulation process;
(iii) a steam flooding process;
(iv) a solvent-assisted steam flooding process;
(v) a steam-assisted gravity drainage process;
(vi) a solvent-assisted steam-assisted gravity drainage process;
(vii) a heated vapor extraction process;
(viii) a liquid addition to steam to enhance recovery process; and
(ix) a near-azeotropic gravity drainage process.

16. The method of claim 15, wherein the method further includes transitioning from performing at least one of the first thermal recovery process in the first thermal chamber and performing the second thermal recovery process in the second thermal chamber to performing the injecting the solvent flood vapor stream into the first thermal chamber and the producing the solvent flood-mobilized viscous hydrocarbons from the second thermal chamber.

17. The method of claim 16, wherein the method includes initiating the transitioning responsive to a transition criteria, wherein the transition criteria includes at least one of:

(i) establishing fluid communication between the first thermal chamber and the second thermal chamber; and
(ii) detecting fluid communication between the first thermal chamber and the second thermal chamber.

18. The method of claim 17, wherein the transition criteria includes at least one of:

(i) production of at least 10% of original oil in place from the subterranean formation;
(ii) production of at least 20% of original oil in place from the subterranean formation;
(iii) production of at least 30% of original oil in place from the subterranean formation;
(iv) production of at least 40% of original oil in place from the subterranean formation;
(v) production of at least 50% of original oil in place from the subterranean formation;
(vi) production of at least 60% of original oil in place from the subterranean formation;
(vii) production of at least 70% of original oil in place from the subterranean formation; and
(viii) production of at least 80% of original oil in place from the subterranean formation.

19. The method of claim 4, wherein at least one of the first thermal recovery process and the second thermal recovery process includes at least one of:

(i) a steam injection process;
(ii) a solvent injection process; and
(iii) a solvent-steam mixture injection process.

20. The method of claim 4, wherein, subsequent to performing the injecting the solvent flood vapor stream and the producing the solvent flood-mobilized viscous hydrocarbons, the method further includes reversing the injecting and reversing the producing, wherein:

(i) the reversing the injecting includes injecting the solvent flood vapor stream into the second thermal chamber; and
(ii) the reversing the producing includes producing the solvent flood-mobilized viscous hydrocarbons from the first thermal chamber.

21. The method of claim 5, wherein the solvent flood vapor stream includes at least one of:

(i) a hydrocarbon;
(ii) an alkane;
(iii) an alkene;
(iv) an alkyne;
(v) an aliphatic compound;
(vi) a naphthenic compound;
(vii) an aromatic compound;
(viii) an olefinic compound;
(ix) natural gas condensate;
(x) liquefied petroleum gas;
(xi) a naphtha product; and
(xii) a crude oil refinery stream.

22. The method of claim 21, wherein a difference between the solvent flood vapor stream dew point temperature and a minimum of the first thermal recovery stream dew point temperature and the second thermal recovery stream dew point temperature is at least one of:

(i) at least 10° C. at 101.325 kilopascals;
(ii) at least 30° C. at 101.325 kilopascals;
(iii) at least 50° C. at 101.325 kilopascals;
(iv) at least 70° C. at 101.325 kilopascals;
(v) at least 90° C. at 101.325 kilopascals;
(vi) at least 110° C. at 101.325 kilopascals;
(vii) at least 130° C. at 101.325 kilopascals;
(viii) at least 150° C. at 101.325 kilopascals;
(ix) at least 170° C. at 101.325 kilopascals;
(x) at least 190° C. at 101.325 kilopascals; and
(xi) at least 210° C. at 101.325 kilopascals.

23. The method of claim 22, wherein the injecting the solvent flood vapor stream includes at least one of:

(i) injecting an unheated solvent flood vapor stream;

(ii) injecting a heated solvent flood vapor stream;

(iii) injecting the solvent flood vapor stream at the solvent flood vapor stream dew point temperature for a target operating pressure within the subterranean formation; and (iv) injecting the solvent flood vapor stream with some degrees of superheat relative to the solvent flood vapor stream dew point temperature for the target operating pressure within the subterranean formation.

24. The method of claim 1, wherein, subsequent to the injecting the solvent flood vapor stream, the method further includes:

(i) injecting a flood gas stream into the subterranean formation via the solvent flood injection well; and (ii) during the injecting the flood gas stream, producing the solvent flood-mobilized viscous hydrocarbons from the solvent flood production well.

25. The method of claim 24, wherein the injecting the flood gas stream includes injecting at least one of:

(i) a non-condensable gas;

(ii) natural gas;

(iii) carbon dioxide;

(iv) nitrogen;

(v) a flue gas;

(vi) methane;

(vii) ethane; and (viii) propane.

26. The method of claim 24, wherein the method includes ceasing the injecting the solvent flood vapor stream prior to initiating the injecting the flood gas stream.

* * * * *